US010741104B2

(12) United States Patent
Kehoe et al.

(10) Patent No.: US 10,741,104 B2
(45) Date of Patent: Aug. 11, 2020

(54) ROAD SIGNS AND METHODS OF MAKING AND USE THEREOF

(71) Applicant: Traffic Engineering Services, LLC, Laurel, MD (US)

(72) Inventors: Joseph Kehoe, New Market, MD (US); Eduardo Barraza, Laurel, MD (US)

(73) Assignee: Traffic Engineering Services, LLC, Laurel, MD (US)

( * ) Notice: Subject to any disclaimer, the term of this patent is extended or adjusted under 35 U.S.C. 154(b) by 0 days.

(21) Appl. No.: 16/393,285

(22) Filed: Apr. 24, 2019

(65) Prior Publication Data

US 2019/0333423 A1 Oct. 31, 2019

Related U.S. Application Data

(60) Provisional application No. 62/662,423, filed on Apr. 25, 2018.

(51) Int. Cl.
*G09F 7/04* (2006.01)
*G09F 7/18* (2006.01)

(52) U.S. Cl.
CPC ..... *G09F 7/04* (2013.01); *G09F 7/18* (2013.01); *G09F 2007/1852* (2013.01); *G09F 2007/1878* (2013.01)

(58) Field of Classification Search
CPC ..... G09F 7/04; G09F 2007/1878; G09F 2007/1852
USPC ..... 40/600
See application file for complete search history.

(56) References Cited

U.S. PATENT DOCUMENTS

| | | | | |
|---|---|---|---|---|
| 3,200,786 | A * | 8/1965 | Swezy | E01F 9/688 116/63 P |
| 4,040,194 | A * | 8/1977 | Penton | G09F 7/04 40/621 |
| 4,090,464 | A | 5/1978 | Bishopp et al. | |
| 4,138,787 | A | 2/1979 | Sarkisian et al. | |
| 4,507,888 | A * | 4/1985 | Robinson | G09F 7/04 40/447 |
| 4,999,938 | A * | 3/1991 | Behling | G09F 7/00 248/624 |
| 5,675,923 | A | 10/1997 | Sarkisian et al. | |
| 6,148,555 | A | 11/2000 | Beauchamp et al. | |
| 6,212,807 | B1 * | 4/2001 | Wright | G09F 7/12 40/450 |
| 6,338,214 | B1 * | 1/2002 | Held | G09F 7/04 40/595 |
| 6,915,605 | B2 | 7/2005 | Lovoie | |
| 7,707,759 | B2 | 5/2010 | Roberts | |
| 2001/0045037 | A1 * | 11/2001 | Bank | G09F 7/04 40/621 |
| 2002/0002783 | A1 * | 1/2002 | Araki | G09F 9/375 40/447 |
| 2003/0233777 | A1 | 12/2003 | Hammer | |

(Continued)

*Primary Examiner* — Kristina N Junge
(74) *Attorney, Agent, or Firm* — Knobbe, Martens, Olson & Bear, LLP

(57) ABSTRACT

Embodiments of adaptable road signs and methods of manufacture are provided. In some embodiments, the adaptable road signs have messages that can quickly be changed by, for instance, applying a placard or banner on the road sign. In some embodiments, the adherence of a placard to the face of the road sign is facilitated by arrays of magnetic features embedded in the sign face and the placard.

19 Claims, 24 Drawing Sheets

(56) References Cited

U.S. PATENT DOCUMENTS

| | | | | |
|---|---|---|---|---|
| 2007/0044360 | A1* | 3/2007 | Hillis | G09F 7/04 40/621 |
| 2010/0299984 | A1 | 12/2010 | Khieu et al. | |
| 2017/0004743 | A1* | 1/2017 | Whitaker | G09F 7/04 |
| 2018/0033347 | A1 | 2/2018 | Myung | |

* cited by examiner

| Sign Name | Sign Code(s) | Sign Image |
|---|---|---|
| LANE ENDS (RIGHT, LEFT) | W4-2R<br>W4-2L | 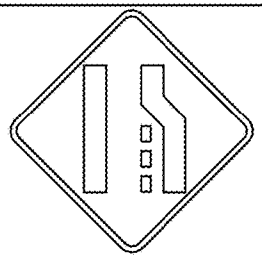 |
| ROAD NARROWS<br>RAMP NARROW | W5-1<br>W5-4 | 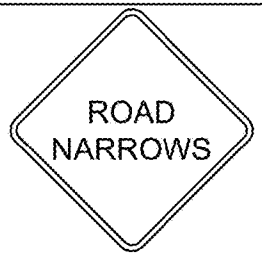  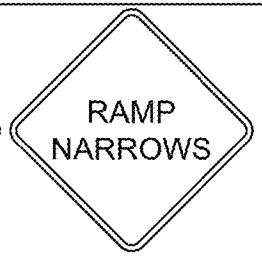  |
| (LEFT, RIGHT) LANE ENDS | W9-1R<br>W9-1L | 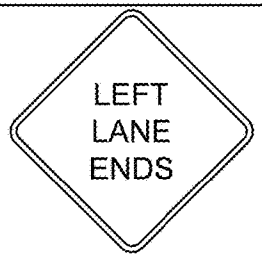  |
| LANE ENDS MERGE<br>(LEFT, RIGHT) | W9-2R<br>W9-2L | 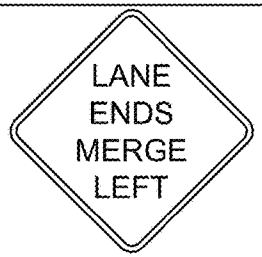  |
FIG. 3C

| | | |
|---|---|---|
| (CENTER, RIGHT, LEFT)<br>LANE CLOSED<br><br>AHEAD, 1500, 1/2 MILE | W9-3C<br>W9-3R<br>W9-3L | CENTER LANE CLOSED AHEAD |
| ROAD WORK<br>ROAD CLOSED<br>UTILITY WORK<br><br>AHEAD, 1500, 1/2 MILE | W20-1<br>W20-3<br>W21-7 | ROAD WORK AHEAD<br>ROAD CLOSED AHEAD<br>UTILITY WORK AHEAD |
| (CENTER, RIGHT, LEFT)<br>LANE CLOSED<br><br>AHEAD, 1500, 1/2 MILE | W20-5C<br>W20-5R<br>W20-5L | CENTER LANE CLOSED AHEAD |

FIG. 3C (Continued)

| Sign Name | Sign Code(s) | Sign Image |
|---|---|---|
| (RIGHT, LEFT) TWO LANES CLOSED<br>AHEAD, 1500, 1/2 MILE | W20-5aR<br>W20-5aL | RIGHT TWO LANES CLOSED AHEAD |
| SHOULDER WORK<br>SHOULDER CLOSED | W21-3 | SHOULDER WORK |
| (LEFT, RIGHT) SHOULDER CLOSED | W21-5aL<br>W21-5aR | LEFT SHOULDER CLOSED |
| ROAD WORK NEXT "X" MILES | G20-1 | ROAD WORK NEXT 5 MILES |
| EXIT ONLY<br>EXIT OPEN<br>EXIT CLOSED | E5-2<br>E5-2a<br>E5-3 | EXIT ONLY<br>EXIT OPEN<br>EXIT CLOSED |

FIG. 3D

| | | |
|---|---|---|
| DETOUR (LEFT, RIGHT) | M4-9L | DETOUR |
| | M4-9R | DETOUR |
| BIKE & PEDESTRIAN DETOURS (LEFT, RIGHT) | M4-9aL | DETOUR |
| | M4-9aR | DETOUR |
| PEDESTRIAN DETOUR (LEFT, RIGHT) | M4-9BL | DETOUR |
| | M4-9bR | DETOUR |
| BIKE DETOUR (LEFT, RIGHT) | M4-9cR | DETOUR |
| | M4-9cL | DETOUR |

FIG. 3D (Continued)

| Sign Name | Sign Code(s) | Sign Image |
|---|---|---|
| (2, 3) (RIGHT, LEFT) CLOSED AHEAD, 1500, 1/2 MILE | W20-5a(1)R<br>W20-5a(1)L | 2 LEFT LANES CLOSED RIGHT |
| (LEFT, RIGHT) ARROW | M6-2R<br>M6-2L | |
| LEFT OR RIGHT MANDATORY TURN | R3-5 | ONLY |
| KEEP (LEFT, RIGHT) | R4-7aR<br>R4-7aL | KEEP RIGHT |
| SIDEWALK CLOSED AHEAD / CROSS HERE (LEFT, RIGHT ARROW) | R9-11 | SIDEWALK CLOSED AHEAD CROSS HERE |
| SIDEWALK CLOSED / CROSS HERE (LEFT, RIGHT ARROW) | R0-11a | SIDEWALK CLOSED CROSS HERE |

FIG. 3E

2014 Traffic Sign Retroreflective Sheeting Identification Guide

U.S. Department of Transportation
Federal Highway Administration

This document is intended to help identify sign sheeting materials for rigid signs and their common specification designations. It is not a qualified product list. FHWA does not endorse or approve sign sheeting materials. Many other sheeting materials not listed here are available for delineation and construction/work zone uses.
Many sign sheeting materials have watermarks and/or patterns that are used to identify the material type and manufacturer. The watermarks shown in this guide have been enhanced. The watermarks will be less visible in practice and may not be present on smaller pieces of sheeting due to the spacing.

Retroreflective Sheeting Materials Made with Glass Beads

| Example of Sheeting (Shown to Scale) | | | | | | | | |
|---|---|---|---|---|---|---|---|---|
| ASTM D4956-04 | I | II | II | III | III | III | III | III |
| ASTM D4956-13 | I | II | II | III | III | III | III | III |
| AASHTO M268-13 | (1) | (1) | (1) | A | A | A | A | A |
| Manufacturer | Several Companies | Avery Dennison® | Nippon Carbide | 3M™ | ATSM, Inc. | Avery Dennison® | Nippon Carbide | ORAFOL Americas Inc |
| Brand Name | Engineer Grade | Super Engr Grade | Super Engr Grade | High Intensity | High Intensity | High Intensity | High Intensity | ORALITE® High Intensity |
| Series | Several | T-2000 | 15000 | 2800 3800 | ATSM HI | T-5500 | N500 | 5800 |
| Notes: | (2) (8) | (3) (4) (9) | (4) | (3) (4) (9) | (4) | (4) | (4) | (4) |

1) Sheeting material does not meet minimum AASHTO classification criteria.
2) Glass Bead Engineer Grade sheeting is uniform without any patterns or identifying marks.
3) Material no longer sold in the United States as of the date of this publication.
4) Section 2A.08 of the 2009 MUTCD (http://mutcd.fhwa.dot.gov) does not allow this sheeting type to be used for new legends on green signs.

FIG. 6A

| Retroreflective Sheeting Materials Made with Micro-Prisms | | | | | | | | |
|---|---|---|---|---|---|---|---|---|
| Example of Sheeting (Shown to Scale) | 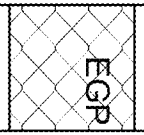  | 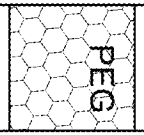  | 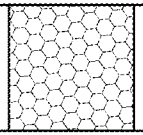 | 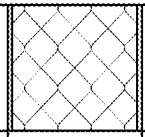 | 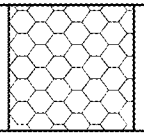 | 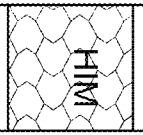  | 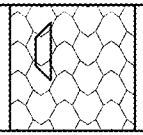 | 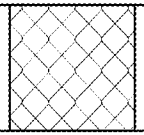 |
| D4956-04 | (5) | (5) | III, IV | III, IV, X | (5) | (5) | (5) / X | (5) |
| D4956-13 | I | I | III, IV | III, IV | III, IV | III, IV | VIII | VIII |
| M268-13 | (6) | (6) | B | B | B | B | B | B |
| Manufacturer | 3M™ | Avery Dennison® | Avery Dennison® | 3M™ | ORAFOL Americas Inc | Nippon Carbide | Nippon Carbide | 3M™ |
| Brand Name | EGP | PEG | HIP | HIP | ORALITE® HIP | HIM | Crystal Grade | Reflective Sheeting |
| Series | 3430 | T-2500 | T-6500 | 3930 | 5900/5930 | CRG 94000 | CRG 92000 | 3940 |
| Notes: | (8) | (8) | | | | | | |

FIG. 6B

| Example of Sheeting (Shown to Scale) | | | | | | | | |
|---|---|---|---|---|---|---|---|---|
| D4956-04 | VIII | VII, VIII, X | IX | IX | (5) | (5) | (5) | (5) |
| D4956-13 | VIII | VIII | IX | IX | IX | IX | XI | XI |
| M268-13 | B | (7) | B | B | B | B | D | D |
| Manufacturer | Avery Dennison® | 3M™ | 3M™ | Avery Dennison® | Nippon Carbide | ORAFOL Americas Inc | 3M™ | Avery Dennison® |
| Brand Name | MVP Prismatic | Diamond Grade™ LDP | Diamond Grade™ VIP | Omni View™ | Crystal Grade | ORALITE® | Diamond Grade™ DG3 | Omni Cube™ |
| Series | T-7500 | 3970 | 3990 | T-9500 | 95000 | 7900 | 4000 | T-11500 |
| Notes: | | (9) | | | (9) | | | |

5) Material was either unavailable in 2005 (previous version of this Guide) or unassigned in the 2004 version of ASTM D4956.
6) Sheeting material does not meet minimum AASHTO classification criteria.
7) Material has been discontinued prior to AASHTO M268-10.
8) Section 2A.08 of the 2009 MUTCD (http://mutcd.fhwa.dot.goc) does not allow this sheeting type to be used for new yellow or orange signs, or new legends on green signs.
9) Material no longer sold in the United States as of the date of this publication.

FIG. 6B (Continued)

ROAD SIGNS AND METHODS OF MAKING AND USE THEREOF

CROSS REFERENCE TO RELATED APPLICATIONS

This patent application claims the benefit of priority to U.S. Provisional Patent Application No. 62/662,423, filed Apr. 25, 2018, which is hereby incorporated by reference in its entirety for all purposes.

FIELD OF THE INVENTION

This application is directed to the field of road signs, and particularly to adaptable road signs with multiple indicators and methods of manufacturing the same.

BACKGROUND

Description of the Related Art

Road signs indicate to passersby (e.g., motorists or pedestrians) traffic conditions and/or hazards and road conditions and/or hazards. Many different types of road signs exist to provide messages to passersby, including construction signs. Conventionally, when road conditions change, the different road conditions require the replacement of the construction signs (e.g., changing from a first sign that indicates a first road condition to a second sign that indicates a second).

SUMMARY

One problem with conventional road signs is that each road sign displays only one message (e.g., an indication, warning, etc.) to passersby. A conventional road sign that indicates a "Construction Area" is not adaptable and cannot be modified to indicate a different road condition or hazard. For instance, it cannot be changed to state: "Construction Zone: 1 Mile Ahead". While some constructions signs have been disclosed with changeable messaging, these signs have not found use for multiple reasons, the most serious of which is that the message indicator portion of the sign does not adhere to the sign backing strongly enough to remain on the sign when exposed to typical road side conditions. For example, high wind speeds (from cars or wind) can blow the message-indicating portion of the sign off, leaving an incorrect message, or no message at all. Other environmental conditions can also lead to the detachment of these messaging portions (e.g., rain, snow, etc.). Because of these issues construction workers rely on conventional signs to indicate road conditions (where single messages are provided). For these signs, if the message on a sign is to be changed, an entirely new road sign must be used to replace the sign to provide the new message. Accordingly, whenever one road condition or hazard has changed and/or another road condition or hazard has arisen, the no longer applicable message on the road sign requires that the entire sign be uninstalled and removed and a new road sign installed. Since conventional road signs are not adaptable to display multiple indicators, during construction, multiple road signs must be manufactured for a single job. Those signs also must be stored and/or maintained. This manufacturing, storage, and/or maintenance requires additional resources, time, space, and effort, causing inconvenience to, for example, construction companies and their workers. Additionally, in some circumstances, because of the burden of changing the messages of road signs, signs with inapplicable messages may be left on the sign even after the road condition has changed. Some embodiments described herein pertain to an improved road sign that solves one or more of these problems or others.

In some embodiments, the road sign is adaptable to provide a plurality of messages (2, 3, 4, 5, 6, 7, or more messages, or a substantially infinite amount of messages). As disclosed elsewhere herein, in some embodiments, the one or more messages is provided on a surface (e.g., a placard, messaging board, a notice board, etc.) that can be coupled to a base sign face. In some embodiments, by changing the message placard, the message of the sign is changed. In some embodiments, as disclosed elsewhere herein, these placards are strongly attached to the base sign face and stay on the sign when exposed to roadside conditions. In some embodiments, the placards remain in-place and/or can withstand exposure to one or more of gusts of winds from vehicles (e.g., including cars and/or trucks), wind and rain from storms (including tropical storms and category 1 hurricane force winds with sustained wind speeds of at least about 74 mph), snow, hail, freezing rain, and/or sleet, and combinations thereof. In some embodiments, the placards remain in-place when exposed to a collision with a motor vehicle traveling equal to or at least about: 15 mph, 25 mph, 35 mph, 50 mph, or ranges including and/or spanning the aforementioned values.

In some embodiments, the road sign includes a main section with a face (e.g., the base sign face). In some embodiments, the face has a coupling area. In some embodiments, the coupling area is configured to receive and couple to a placard (e.g., a plate, sign, poster, etc.). In some embodiments, the placard comprises an indicator message (e.g., in script, text, and/or writing, via symbol, or combinations thereof). In some embodiments, the message written or drawn on the placard is visible to a passerby when the placard is attached to the main section of the adaptable road sign. In some embodiments, a plurality of placards that convey different messages to motorists are provided and can be substituted, swapped, or combined with one another to provide a variety of messages to a passing motorist or pedestrian (e.g., a passerby).

In some embodiments, the face is the portion of the sign that is presented to a passerby for viewing. In some embodiments, the coupling area holds the placard on the face when the face is in a vertical or substantially vertical position. In some embodiments, the coupling area is configured to adhere the placard to a face of the main section so that the placard is visible to a passerby. In some embodiments, the coupling area is flush or substantially flush with the face of the sign. In some embodiments, where the coupling area of the sign is flush with the face of the sign, the placard protrudes slightly from the sign face when coupled to the sign. In other embodiments, the coupling area is recessed within the face of the main section (e.g., the main section comprises a recessed portion). In some embodiments, where present, the recess can be configured to receive the placard. In some embodiments, the recess of the main section can have a coinciding shape and/or size to that of the placard so that the placard fits snugly or tightly into the recess. In some embodiments, once the placard is placed in the recess, the placard is flush or substantially flush with a plane created by the face of the sign. In some embodiments, where a recess is present, the recess of the sign comprises a notch or finger hold that allows a user to pull the placard out of the recess. In some embodiments, the placard comprises a notch or finger hold that allows a user to pull the placard out of the recess. In some embodiments, the sign lacks a recess and/or lacks any coupling implement (e.g., that holds the placard on the sign face) that is visible to the naked eye (e.g., the implements that adhere the placard to the sign can be hidden from view and/or substantially invisible on visual inspection of the placard and the sign face).

In some embodiments, the coupling area can include at least one coupling feature and/or a plurality of coupling features. In some embodiments, the coupling feature can include one or more magnets, fasteners, adhesives, or combinations thereof. In some embodiments, the coupling feature can include one or more magnets. In some embodiments, the one or more magnets comprises one or more magnetic materials such as neodymium iron boron, samarium cobalt, alnico, ceramic, ferrite, iron nitride, or combinations thereof.

In some embodiments, the coupling features of the sign are positioned in an array. In some embodiments, for instance, one or more magnets are positioned in an array. In some embodiments, the array of the coupling features can coincide to a matching array on the placard. In some embodiments, the coupling features are positioned within the road sign such that a surface of the one or more coupling features is substantially flush with a surface of the coupling area. In some embodiments, the array of the sign or placard is provided as coupling features that together form different shapes (e.g., coupling features positioned as a grid, as vertices of a repeating diamond pattern, around a circle, etc.) and sizes (spacing between the coupling features and the size of the coupling feature field itself). In some embodiments, the array comprises a number of polygons or shapes where magnets are located at the vertices of the polygons. In some embodiments, the shapes include one or more triangles, squares, trapezoids, rectangles, pentagons, diamonds, and/or combinations thereof. In some embodiments, the center of two adjacent coupling features (e.g., magnets) can be spaced apart by equal to or less than about: 6 inches, 4 inches, 2 inches, 1 inch, or ranges including and/or spanning the aforementioned values. In some embodiments, each of the coupling area and the placard can have a width or height equal to or less than about: 24 inches, 18 inches, 12 inches, 6 inches, or ranges including and/or spanning the aforementioned values.

In some embodiments, the coupling area comprises one or more fasteners. In some embodiments, the placard comprises a corresponding feature and/or fastener that couples to the coupling area. In some embodiments, the fastener can include one or more of a hook (e.g., with a corresponding loop on the placard or vice versa), a strap, a peg (e.g., with a coinciding hole on the placard or vice versa), a hanging wire (e.g., with a corresponding hook on the placard or vice versa), a clasp (e.g., with a corresponding attachment on the placard or vice versa), a clamp, a hook-and-loop fastener, or combinations thereof. In some embodiments, the fastener is an adhesive. In some embodiments, the adhesive comprises one or more of a rubber adhesive, an anaerobic adhesive, a cyanoacrylate adhesive, an epoxy adhesive, a polyurethane adhesive, a phenolic adhesive, a silicone adhesive, a polyimide adhesive, a polyvinyl acetate adhesive, a pressure-sensitive adhesive. In some embodiments, the fastener is a frictional adhesive (e.g., a roughening on the placard or sign that provides additional adhesion between the two once coupled). In some embodiments, the fastener is velcro. In some embodiments, the coupling features do not comprise velcro. In some embodiments, the coupling features do not comprise an adhesive. In some embodiments, the coupling area lacks one or more or all of these fasteners and is held on solely with magnets.

In some embodiments, the face can include a visual indicator (e.g., a message that is written or drawn). In some embodiments, as disclosed elsewhere herein, the placard can also or alternatively include a visual indicator. In some embodiments, the visual indicator of either the face or the placard can include one or more of pictorial representations or a written language. In some embodiments, the visual indicators of the face and the placard can be different. In some embodiments, the visual indicators of the face and the placard can be the same. In some embodiments, the visual indicator of the placard can cover a portion of the writing or picture on the sign face to produce a new message. In some embodiments, the face does not include a visual indicator.

In some embodiments, the face of the sign is configured to receive a plurality of placards at one time and/or simultaneously (e.g., 2, 3, 4, or more). For example, in some embodiments, the sign comprises multiple coupling areas and/or comprises a coupling area that is large enough to accommodate a plurality of placards. For instance, in some embodiments, the coupling areas are sized to receive multiple placards together simultaneously. In some embodiments, the placards can be mixed and matched to provide a variety of messages to passersby. In other embodiments, the face of the sign is configured to receive only a single placard. In some embodiments, a placard can be configured to interact with the sign face coupling feature array at only one area of the sign face, while other placards can be configured to interact with other areas of the sign face coupling feature array. In some embodiments, this provides a safety feature that prevents incorrect messaging from being displayed on the sign face (e.g., through a mistake by a construction worker, or through tampering).

In some embodiments, the main section can be made from plastic, wood, or metal. In some embodiments, the road sign can include a placard, which can be made from plastic, wood, or metal. In some embodiments, the placard is made of the same materials or of different materials than the main section.

In some embodiments, the main section includes a coupling area comprising a plurality of magnetic features. In some embodiments, the coupling area is configured to adhere a placard to the face of the main section (e.g., via a magnetic force) when the face is in a substantially vertical position. In some embodiments, the face of the main section is substantially flat. In some embodiments, the plurality of magnetic features includes at least a first magnetic element and at least a second magnetic element. In some embodiments, the first and second magnetic elements at a particular position on the face of the sign have different polarities.

In some embodiments, the road sign includes a placard as opposed to being separate from and configured to adhere a placard. In some embodiments, the placard comprises a second plurality of magnetic features. In some embodiments, the magnetic features of the sign are arranged in an array. In some embodiments, the second plurality of magnetic features is arranged in an array that coincides with at least a portion of the array of magnetic features on the road sign. In some embodiments, the coinciding magnets have opposite polarities so that the magnetic features of the road sign are attracted to the coinciding magnetic features of the placard.

In some embodiments, the plurality of magnetic features includes two or more magnetic features and less than about 35 magnetic features. In some embodiments, the plurality of magnetic features are configured so that the placard can adhere to the face of the main section only if the placard is in an upright position. In some embodiments, the magnetic features are embedded within the main section of the sign and are substantially flush with the sign face.

In some embodiments, the magnetic features of the placard are embedded within the placard and are substantially flush with a face of the placard. In some embodiments, the magnetic features of the placard are embedded within the placard so that the magnetic elements produce a magnetic force on both sides of the placard that is sufficient to hold the placard on the sign. In some embodiments, the message on the front surface of the placard is different from the message on the back surface of the placard.

In some embodiments, the sign face does not have any tracks or ledges that are configured to suspend the placard. In some embodiments, the sign face does not have any adhesive element other than the plurality of magnetic features.

In some embodiments, the magnetic features are arranged in an array. In some embodiments, some of the magnetic features are arranged as points on a polygon. In other embodiments, some of the magnetic features in the array are arranged as points on a line. In some embodiments, some of the magnetic features in the array are spaced apart uniformly. In some embodiments, three magnetic features are arranged as points on a triangle (e.g., with one angle that is between 15 and 90 degrees).

In some embodiments, the sign face includes an array, as described above, in which with respect to any two magnets in the array the ratio of the mass of the two magnets relative to the distance between the two magnets is sufficient so that neither of the two magnets substantially interferes with the coupling of any of the magnets in the array. Magnets have two poles, called the north (N) and south (S) poles. Any two magnets will be attracted by their opposite poles. In some embodiments, the array (e.g., the grid of magnets) is designed so that any given placard will adhere to the sign face and not interfere with the placement of any other placard on the sign face.

Some embodiments pertain to a message conveying system comprising any one or more of the features listed above. For example, in some embodiments, the system contains a placard. In some embodiments, the placard is rigid. In some embodiments, the placard is large enough to display an entire word or phrase. In some embodiments, the phrase displayed on the placard is readable by traffic. In some embodiments, the phrase displayed on the placard is readable from at least about 500 feet away. In some embodiments, the phrase displayed on the placard includes letters according to certain dimensions (e.g., between 0.5 and 5.0 inches in width and between 0.5 and 5.0 inches in height).

Some embodiments pertain to a method of making or using an adaptable sign. In some embodiments, the method comprises providing a single, base road sign. In some embodiments, the base can be adapted to display multiple indicators and messages. In some embodiments, one or more placards can be removably attached to the main section. In some embodiments, when the one or more placards are attached to the main section of the sign, the face of the main section is substantially flat. In some embodiments, various fasteners capable of securely holding the placard on the main section of the road sign are incorporated on or within the base sign to attract and/or adhere the placard to the main section.

In some embodiments, the method comprises providing a main section with a face. In some embodiments, the method comprises providing a coupling area. In some embodiments, the coupling area can be configured to receive and adhere to a placard. In some embodiments, the coupling area can be configured to adhere the placard to the face when the face is in a substantially vertical position. In some embodiments, the main section can be removably attached to a support structure.

In some embodiments, the method comprises providing a coupling area including at least one coupling feature. In some embodiments, the coupling feature can include one or more of a magnet, fastener, or adhesive. In some embodiments, a placard with a corresponding feature is provided. In some embodiments, the coupling area can include a coupling feature which can include one or more magnets. In some embodiments, the one or more magnets can include one or more of neodymium iron boron, samarium cobalt, alnico, ceramic, ferrite, and iron nitride. In some embodiments, the coupling area can include a coupling feature that can include one or more fasteners. The one or more fasteners can include one or more of a hook, a strap, a peg, a hole, a hanging wire, a clasp, a clamp, and a hook-and-loop fastener.

Some embodiments pertain to a kit comprising any one or more of the features listed above, including a placard. In some embodiments, the kit comprises a stand for the road sign.

BRIEF DESCRIPTION OF THE DRAWINGS

FIGS. 3C-E provide a list of drawings that can be placed on the placard and/or the sign face as indicators of road conditions or hazards, along with the name and code(s) that correspond to each drawing.

FIG. 6A lists examples of retroreflective sheeting materials made with glass beads that can serve as the masking material in some embodiments of the road sign and in some embodiments of methods of manufacturing the road sign.

FIG. 6B lists examples of retroreflective sheeting materials made with glass beads that can serve as the masking material in some embodiments of the road sign and in some embodiments of methods of manufacturing the road sign.

DETAILED DESCRIPTION

Figure 1A:
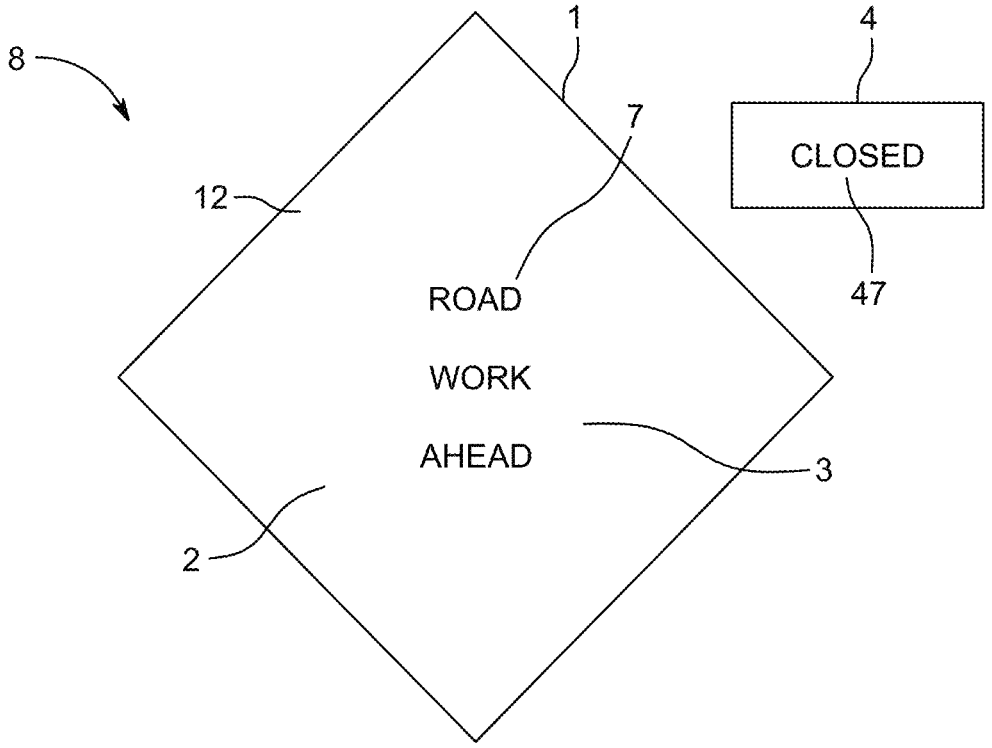
FIG. 1A is a front view of an embodiment of a road sign and a placard.

Some embodiments disclosed herein pertain to adaptable road signs. In some embodiments, the adaptable road signs have visual indicators (e.g., written or symbolic messages) that can be reversibly switched, swapped, and/or changed. For instance, in some embodiments, the road sign comprises a coupling area that binds to a placard. In some embodiments, the placard comprises the visual indicator (e.g., has a message written on it). Because multiple placards with multiple messages are possible, changing the message indicated on the sign requires only changing the placard. Further, a single placard may have different messages on either of its two faces (e.g., one message on its front face and a second, different message on its back face), so that changing the message can be accomplished by flipping the placard. A variety of adaptable road signs and methods of manufacturing adaptable road signs are described herein to illustrate various examples that may be employed to achieve one or more desired improvements. These examples are only illustrative and not intended in any way to restrict the general inventions presented and the various aspects and features of these inventions. Furthermore, the phraseology and terminology used herein is for the purpose of description and should not be regarded as limiting. No feature, structure, or step disclosed herein is essential or indispensable.

Conventional construction signs permanently indicate specific road conditions or hazards with written or pictorial representations. For example, a construction sign that reads "Left Lane Closed Ahead Merge Right" permanently indicates that there is a lane closed farther down the road regardless of whether that lane is actually closed. Once the lane is reopened, the construction sign must either be removed or replaced to prevent passersby from receiving incorrect information about current road conditions. Without an updated construction or road sign, drivers or pedestrians (e.g., passersby) could incorrectly assume that the indicated road condition is still ongoing or could assume that the current, actual road condition is not present, which could cause accidents or injury. For instance, if the left lane is re-opened and the right lane is then closed, a "Left Lane Closed Ahead Merge Right" could cause confusion and accidents on the roadway.

Indeed, because many road conditions or hazards may be continuously changing, periodically changing, and/or change in a recurring fashion (requiring switching back and forth between signs) the chance that a scheduled sign change is missed is elevated. Construction may occur only on certain days of the week. Additionally, there may be conditions that are seasonal, such as warnings that certain wild animals are nearby, that tractor trailers or logging trucks are in use, or that "Frost Heaves" are present. Often when the conditions or hazards that these road signs indicate become inapplicable, other conditions or hazards arise of which passersby should be made aware. In these situations, it is both burdensome and time-consuming to remove construction signs with warnings or indications that no longer apply, and to replace them with new construction signs.

As an illustration, a construction crew may desire, at various times throughout a week or month, to indicate "Road Construction Ahead," "Warning: Construction Area," "Road Construction 5 Miles," or "End of Construction." Each of these indicators conveys a slightly different message to passersby and which message is appropriate may depend on how far along the construction has progressed. Use of conventional signs requires large resource expenditures on manufacturing and installing these various signs. Adding to inconvenience, as one conventional construction sign becomes inapplicable in view of the progress of the construction, not only must the new sign be installed, but the out-of-date construction sign must be removed. Conventional construction signs are large and cumbersome. A construction sign itself, without its stand, can be several feet wide and tall and can weigh several pounds. Signs with stands are even larger, heavier, and more awkward. Thus, the size and weight of the sign stand and sign together make them challenging to move.

Some embodiments described herein solve one or more of these problems or other problems associated with conventional road signs by providing an adaptable road sign. In some embodiments, the adaptable road sign has a changeable message that remains adhered to the face of the sign even when exposed to harsh roadside conditions. In some embodiments, the adaptable road sign comprises a coupling area that couples to a placard. In some embodiments, because different placards can be provided with different messages, changing the message on the road sign is performed by simply changing the placard. In some embodiments, a single placard will have two different messages on its two different faces, so that changing the message on the road sign is performed by simply flipping the same placard that was already on the road sign. In some embodiments, when the placard is held upright so that the word or symbol displayed on its front side is displayed correctly, the word or symbol displayed on its rear side will be upside down. Any two messages disclosed herein can be used on the front or rear face of the placard. In some embodiments, as disclosed elsewhere herein, the placard can have a specific pattern (e.g., a specific array) of coupling features that allows it to adhere and/or mate with a coinciding array on the sign face. In some embodiments, the arrays (e.g., on the placard and the sign) allow the placard to only couple to appropriate areas of the sign. In some embodiments, the adaptable road signs as disclosed herein, allow road signs with appropriate indicators of conditions or hazards to be set up faster, more easily, and more efficiently. In some embodiments, one or more features of the adaptable road signs disclosed herein reduce the amount of manufacturing materials required and/or the amount of waste produced during sign manufacture or disposal. In some embodiments, the adaptable signs disclosed herein reduce installation and de-installation time, effort, and/or equipment required when compared to conventional signs. In some embodiments, the use of the adaptable signs disclosed herein increases the efficiency with which signs are changed. In some embodiments, by virtue of one or more features of the road signs disclosed herein (e.g., array patterns, etc.), the incidences of accidentally placing a wrong indicator on the sign face are decreased and/or substantially stopped.

In some embodiments, instead of requiring personnel to carry multiple signs or to travel off worksites to retrieve other signs, which are large and cumbersome to move, road workers can carry relatively small, easy-to-transport placards that comprise particular warnings, indications, symbols, messages, and wording that are required at a construction site. In some embodiments, these placards quickly and easily can be placed on the face of the sign to change the indication on the sign. For example, by changing between two placards, a sign may provide an indication that there are "Men At Work" (from one placard) during work hours of the day, and provide that the area is a "Construction Zone" (from a second placard) after the workday is complete. When the workday starts again, the workers can swap the "Construction Zone" placard off the base sign and reintroduce the "Men At Work" sign. Alternatively, a single placard may read "Men At Work" on one side and "Construction Zone" on the other side, so that changing the message indicated on the sign requires only flipping the placard.

In some embodiments, the use of placards as disclosed herein is simpler and requires fewer hours for installation and movement than the installation of a whole new sign. For example, whole signs must usually be stored off of a worksite to prevent damage to them or the chances that a passerby may take or change them (e.g., to provide an incorrect message as a prank, etc.). Placards can be taken to a worksite each day in a truck and/or can be stored in a lock box at the worksite. The use of the placards (which are, in some embodiments, smaller and/or lighter than whole signs) also allows for less manufacturing burden and material waste, because a single stand and sign can be adapted to display multiple different placards with various visual indicators. Also, if a sign is damaged (e.g., by vandals, by being hit by a car, etc.), a blank sign can be used to replace it. Thus, for rarer or more obscure messaged signs, for which duplicates are not kept on hand, the whole sign need not be reordered. The rare messaged placard is simply removed from the damaged sign and placed back on the new blank sign. Alternatively, extra placards can be more easily stored for replacement.

Additionally, because the placards adhere to the sign face with sufficient strength (e.g., magnetically) to remain attached in any road conditions for which conventional construction signs are designed and rated, adaptable signs offer a safe alternative to conventional signs. For instance, in some embodiments, while the placard is reversibly attachable to the face, the placard couples to the face with enough strength and/or adhesive force such that wind, debris from the road, movement of the sign, and/or impacts to the sign do not dislodge the placard from the sign face. As another example, in some embodiments, the placard is configured to receive and/or comprises one or more tamper resistant features. In some embodiments, the tamper-resistant features include one or more of locking feature (e.g., a slide lock(s) that partially covers one or more portions of the placard, a latch(es) that locks the placard in place, a key and lock, etc.). In some embodiments the tamper-resistant feature advantageously makes the placard more difficult to remove or displace. In some embodiments, arrays of coupling features (e.g., magnets) also offer tamper resistance. For example, the magnetic pull may be strong enough that a passerby would not be able to remove the placard without significant strain and effort. In some embodiments, one coupling feature (e.g., magnets) are coupled with another, such as a locking feature that requires particular skill to unlock. Alternatively, in some embodiments, the coupling features can include tamper-evident or tamper response features (e.g., a flashing light or an alarm sound that is triggered in the event of tampering) that deter tampering.

In some embodiments, the placard couples to the face with sufficient strength to satisfy the Federal Highway Administration's National Standards for Traffic Control Devices. For example, the placard couples to the face with sufficient strength to be crashworthy if the road sign is within the clear zone (i.e., the total roadside border area, starting at the edge of the traveled way, that is available for an errant driver to stop or regain control of a vehicle). In some embodiments, the placard couples to the face with sufficient pull strength to satisfy the relevant US state requirements for construction sign and/or road sign safety. In some embodiments, the placard couples to the face with sufficient adhesion strength to satisfy the relevant US state requirements for construction sign and/or road sign safety. In some embodiments, the road sign is made of crash grade material to satisfy the Federal Highway Administration's National Standards for Traffic Control Devices. In some embodiments, the placard is made of crash grade material to satisfy the Federal Highway Administration's National Standards for Traffic Control Devices.

In some embodiments, the adhesion of the placard to the sign is measured in terms of peel strength. The peel strength can be measured as the average load per unit width of bond line required to separate bonded materials where the angle of separation is 180 degrees. In some embodiments, to measure peel strength a tab is attached to the placard irreversibly. Then, the placard is attached to the sign with coinciding coupling features (e.g., magnets) and a peel force testing apparatus is set-up to peel the placard and/or separate the placard from the sign. The apparatus pulls the placard via the tab along the direction of a longest linear feature of the placard. In some embodiments, the initial peel force (in Newtons) to remove the placard from the sign is greater than or equal to about: 0.5 N, 1 N, 2 N, 4 N, 6 N, 10 N, or ranges including and/or spanning the foregoing values.

In some embodiments, as disclosed elsewhere herein, an adaptable road sign is provided. In some embodiments, the adaptable road sign is provided in the form of a kit. In some embodiments, the kit includes the road sign's main section, at least one placard, a retroflective layer, coupling features (e.g., magnets), and a sign stand. In some embodiments, the kit further comprises one or more of the tools required to assemble a road sign ready for use. In other embodiments, the adaptable road sign is not provided as a kit.

In some embodiments, the adaptable road sign comprises a face configured for viewing by passersby. In some embodiments, on, embedded within and substantially flush with, or attached to the face of the adaptable sign is one or more coupling features. In some embodiments, the coupling features can reversibly connect to, receive, and/or couple to a placard. In some embodiments, the coupling features comprise a plurality of magnets arranged in an array. In some embodiments, the placard comprises a written message or drawing that is displayed on the sign after the placard is attached to the sign face. In some embodiments, placards allow the construction sign to display any indicator of any road condition or hazard and can be swapped or changed as desired by a user. In some embodiments, the magnetic features of the placard are embedded within the placard such that the magnetic elements produce a magnetic force on both sides of the placard that is sufficient to hold the placard on the sign. In some embodiments, the placard has a different message on its front and back surfaces. In some embodiments, the placard adheres to the sign in different areas of the sign face depending on which message is displayed on the placard (by virtue of, for example, the differing array of polarities produced by the magnets from the front face and the back face through the placard).

Figure 1B:
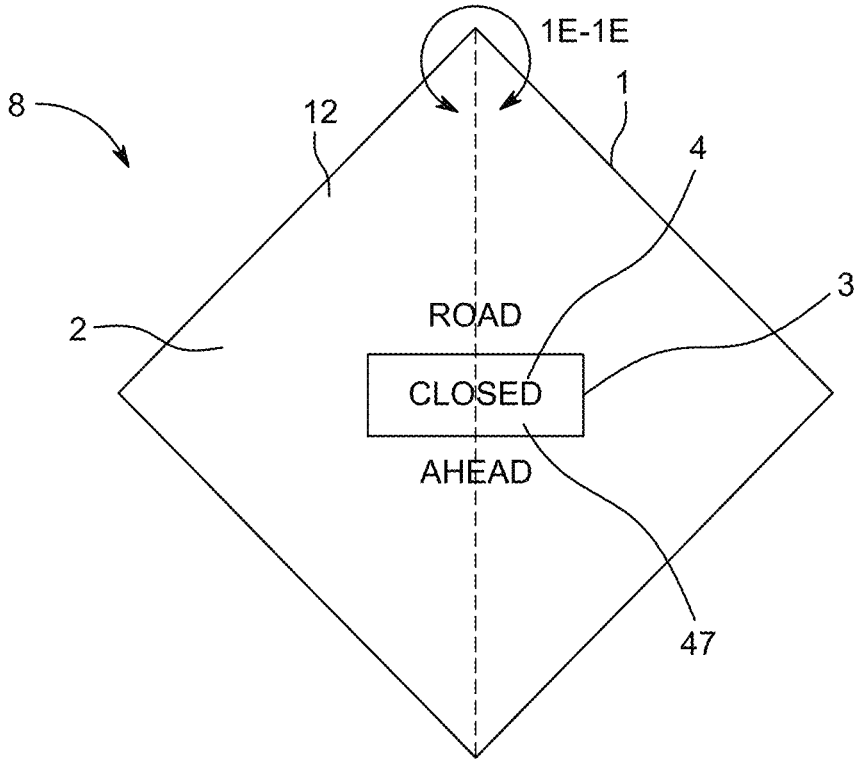
FIG. 1B is a front view of the embodiment of FIG. 1A with the placard of FIG. 1A attached.
Figure 1C:
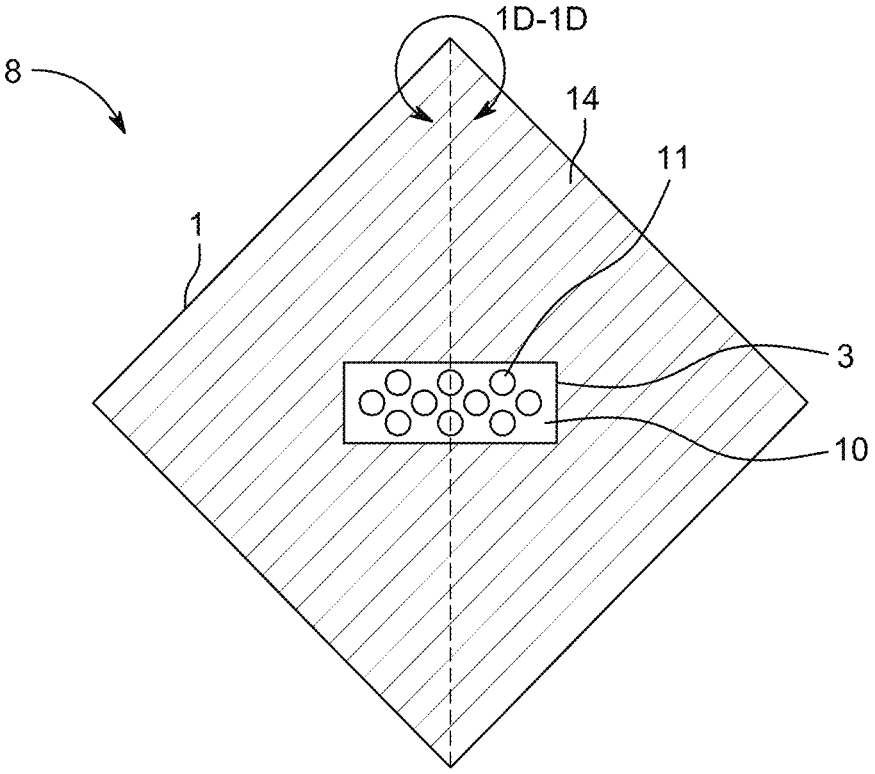
FIG. 1C is a view of the embodiment of FIG. 1A with a masking material of the sign face removed.
Figure 1D:
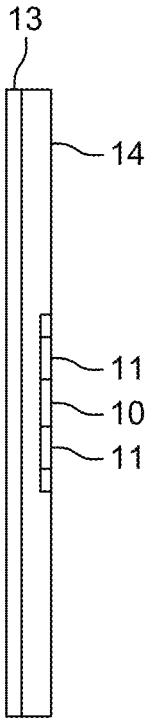
FIG. 1D is a cross-sectional view of the road sign of FIG. 1C.
Figure 1E:
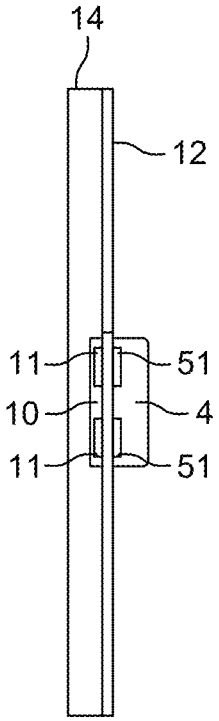
FIG. 1E is a cross-sectional view of the road sign of FIG. 1B with the placard attached.
Figure 2A:
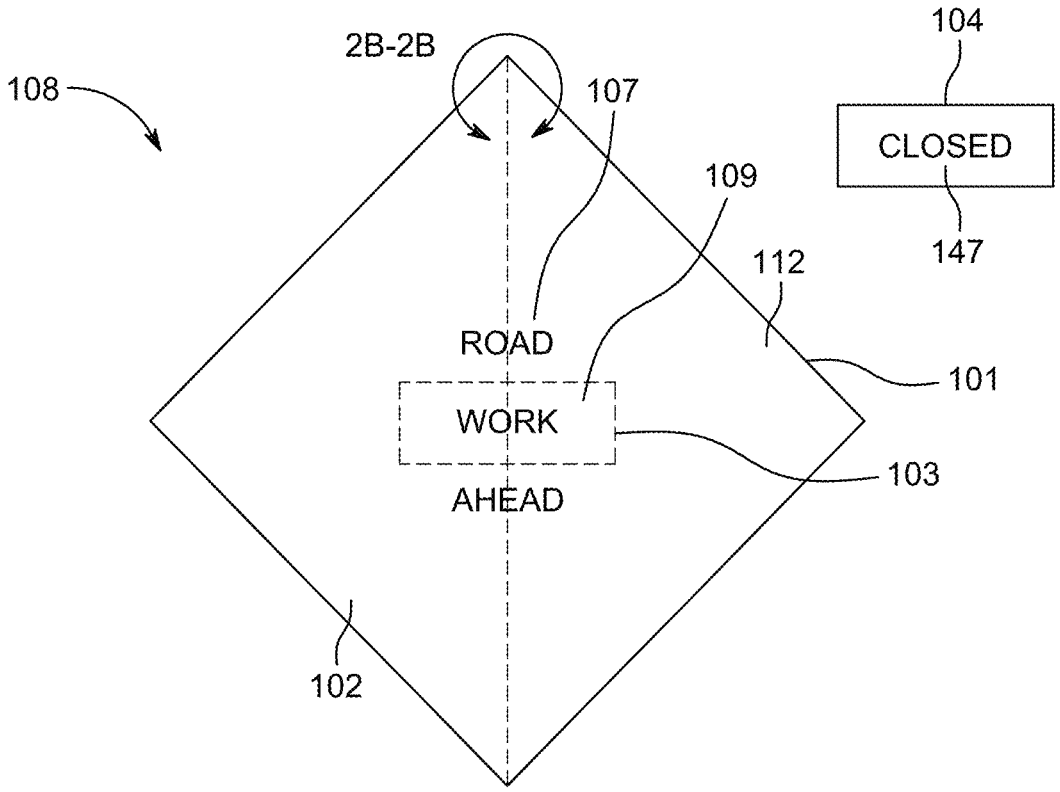
FIG. 2A is a front view of another embodiment of a road sign and a placard.
Figure 2B:
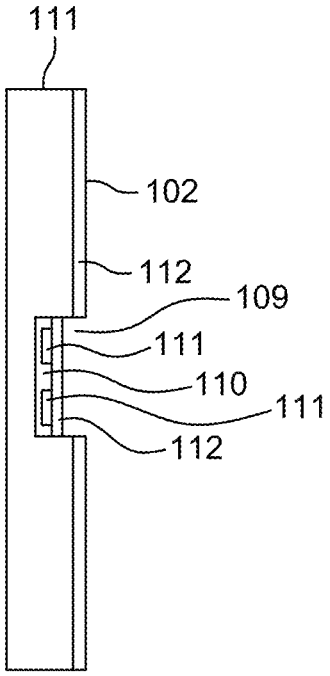
FIG. 2B is a cross-sectional view of the road sign of FIG. 2B.
Figure 2C:
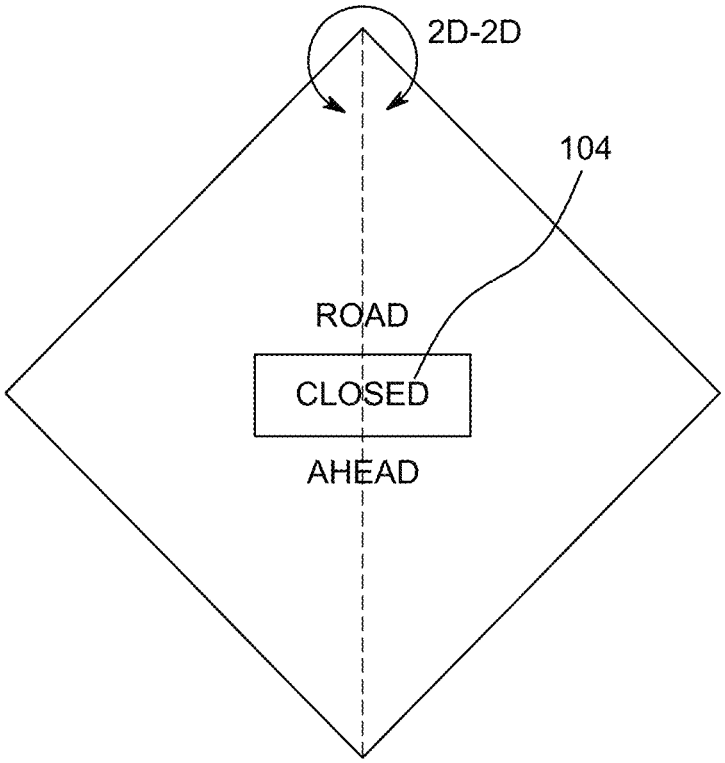
FIG. 2C is a front view of the embodiment of FIG. 2A with the placard of FIG. 2A attached.

In some embodiments, as shown in FIGS. 1A and 2A, the adaptable road sign face comprises its own visual indicator (e.g., "Road Work Ahead", etc.) providing a default message. In some embodiments, as shown in FIGS. 1B and 2C, the placard covers only part or a portion of the default message but changes the message on the sign. For example, in some embodiments, a portion of the default message remains visible and the placard, in combination with the visible portion of the default message, provide an indication of the road condition. For instance, as shown in FIGS. 1A-2D, a default message of a "Road Work Ahead" can be modified with a placard reading "Closed" so that the message on the sign is "Road Closed Ahead." As another illustration, a placard with an indicator reading "Warning" and another placard with an indicator reading "Area" may be temporarily affixed to a default sign face that states "Construction Ahead", so that the sign face's indicator reads "Warning Construction Area" with a placard covering the word "Ahead" with "Area". In other words, in some embodiments, as described elsewhere herein, the placard does not cover substantially the entire wording of the default message. In some embodiments, the placard in combination with the underlying sign provide an indication of the street condition.

In other embodiments (not shown), where a default message is present on the sign face, a placard can be sized to substantially cover the entire default message on the sign face so that the indicator on the sign face is substantially or completely obscured from the view of, for example, a passerby. For example, the indicator on the sign face may read "Men Working," but this indicator may be completely obscured or substantially obscured by a placard that reads "Be Prepared To Stop." Alternatively, an indicator on the sign face that reads "Construction Zone" may be substantially or completely covered with a message indicating "Speed Limit 55 MPH".

In other embodiments (not shown), the face of the construction sign itself comprises no message (e.g., visual indicator, visual cue, etc.). In some embodiments, by attaching a placard to the sign, the sign becomes indicative of a particular road condition (e.g., "Construction Zone," "Slow," "End of Construction Zone," etc.).

In other embodiments, e.g., where the face of the sign is blank (e.g., without a default message) or comprises a default message, a plurality of partial message placards can be assembled in a variety of ways to give various warnings (e.g., combining "Road" with "Closed" and "Ahead" to provide a sign stating "Road Closed Ahead").

In some embodiments, the indicator on the placard and/or the indicator on the sign face may be any one or more of the following or any portion of one of the following (e.g., any single word of one of the following messages): "STOP"; "Truck Escape Ramp"; "Emergency Signal Ahead"; "Photo Enforced"; "No Train Horn"; "No Signal"; "Utility Work Ahead"; "Shoulder Work"; "Right Shoulder Closed"; "Right Two Lanes Closed ½ Mile"; "Exit Closed"; "Road Work Next 5 Miles"; "End Road Work"; "Slow Traffic Ahead"; "Construction Ahead"; "Construction Entrance"; "No Entrance"; "Road Construction Ahead"; "End Construction"; "No Construction Traffic"; "Heavy Truck Traffic"; "Construction Zone Speed Limit 10 MPH"; "Stop No Construction Traffic"; "Hard Hat Area"; "Speed Fines Doubled In Construction Zones When Workers Present"; "Under Construction"; "Give 'Em a Brake Slow Down"; "Accident Ahead"; "Raise Plow Ahead"; "Be Prepared To Stop"; "Slow Moving Vehicles"; "Watch For Falling Objects"; "Road Construction 1 Mile"; "Road Construction 1000 FT"; "Road Construction 1500 FT"; "Road Construction 250 FT"; "Road Construction 500 FT"; "Caution Manhole"; and "End Blasting Zone." In some embodiments, placards can comprise individual alpha numeric indicators (e.g., any letter from "A" to "Z" or any integer from "0" to "9") that can be combined to provide a message to passersby. In some embodiments, the indicator on the placard and/or the indicator on the sign face may any one or more of the images listed in FIG. 3.

In some embodiments, where located on the side of a roadway, the message of the placard (and/or the placard itself) is large enough to be read from a motorist traveling passed the sign (e.g., at the posted speed limit). In some embodiments, for example, the dimensions of the letters of each word or phrase of the indicator are sufficiently large so that the word or phrase is readable from a distance that is equal to or less than about: 50 feet, 100, feet, 150 feet, 300 feet, 450 feet, 550 feet, 650 feet, 700 feet, or ranges including and/or spanning the aforementioned values. In some embodiments, the dimensions of the letters of each word or phrase of the indicator are sufficiently large so that the word or phrase is readable from a distance that is equal to or less than about: 300 feet, 450 feet, 650 feet, 850 feet, 1000 feet, 1150 feet, 1300 feet, 1450 feet, or ranges including and/or spanning the aforementioned values. In some embodiments, the indicator on the placard or, as the case may be, on the sign face, includes a word or phrase, each letter of which has a width that is equal to or less than about: 15 mm, 30 mm, 45 mm, 60 mm, 75 mm, 90 mm, 105 mm, 120 mm, 140 mm, or ranges including and/or spanning the aforementioned values. In some embodiments, the indicator includes a word or phrase, each letter of which has a height that is equal to or less than about: 15 mm, 30 mm, 45 mm, 60 mm, 75 mm, 90 mm, 105 mm, 120 mm, 140 mm, or ranges including and/or spanning the aforementioned values. While the strength of adhesion and other properties disclosed herein make some embodiments especially useful for construction and road signage specifically, in some embodiments, for brevity, other types of signs are also envisioned in addition to road signs and/or construction signs. For example, in some embodiments, changeable menus, changeable pricing signs (at gas stations, etc.), and other changeable signs are envisioned. In some embodiments, these signs have arrays for prices at one location of the sign face (e.g., on a right-hand side of the sign) and arrays coinciding to specific items (such as entrees, other sale items, etc.) on a separate location of the sign (e.g., on a left-hand side of the sign). In other embodiments, the signs are only for use as construction signs and as road signs and other applications are not envisioned.

As disclosed elsewhere herein, FIG. 1A illustrates an embodiment of an adaptable road sign 8. In some embodiments, as shown, the road sign 8 has a main section 1 comprising a face 2. In some embodiments, the face 2 comprises a masking material 12. In some embodiments, the masking material can be colored (red, orange, white, green, etc.) and/or can be reflective. In some embodiments, the face 2 of the road sign 8 comprises a coupling area 3. In some embodiments, as described elsewhere herein, the coupling area 3 is configured to adhere to a placard 4.

As shown in FIG. 1A, the sign 8 can have one visual indicator 7 and the placard 4 can have another different visual indicator 47. In some embodiments, as shown in FIG. 1B, the placard 4 can adhere to the sign 8 to provide a combination message that is different from the visual indicator 7, 47 of the placard 4 or the sign 8. In some embodiments, the placard 4 comprises a masking material that can be the same or different from the masking material 12 of the sign 8. In some embodiments, the masking material of the placard can be colored (red, yellow, orange, white, green, etc.) and/or can be reflective.

In some embodiments, the coupling area 3 is configured to receive and adhere to the placard 4. In some embodiments, the placard 4 can be placed and/or adjusted on or into the coupling area manually (e.g., by-hand and/or without tools). In some embodiments, the configuration of the coupling area 3 to receive and adhere to the placard 4 can be adjusted only with the aid of non-mechanical and/or non-electrical hand tools. In some embodiments, the face 2 has only one coupling area 3. In other embodiments, the face 2 has more than one coupling area 3.

In some embodiments, as can be seen when comparing FIG. 1A and FIG. 1C, the coupling area 3 comprises at least one coupling feature 11. FIG. 1C shows a front view of the road sign 8 of FIG. 1A where the masking material 12 has been removed exposing the inside of the sign. As shown, in some embodiments, the main section 1 of the sign 8 comprises a sign material 14. In some embodiments, within the sign material 14 is embedded or affixed one or more coupling members 11. In some embodiments, a notch or recess is carved out of the sign material 14 of the main section 1 and the coupling members (e.g., coupling features) 11 are inserted in place on the material 14. In some embodiments, a resin or epoxy can be mixed and added to the notch or recess. In some embodiments, once hardened, forming a coupling member support 10, the resin (or fixative, e.g., injection molded plastic, and/or plastic, rubber, wood and/or metal template support) holds the coupling members 11 in place. In some embodiments, the fixative 10 and/or coupling members 11 can be prefabricated and inserted into the notch after prefabrication. Alternatively, in some embodiments, the coupling members can be directly inserted into the sign material 14 of the main section 1 without a fixative area 10 (e.g., by placing or screwing the members into holes drilled or cut out of the sign material).

FIG. 1D shows a bisected side view of the road sign 8 of FIG. 1C along line 1D-1D. In some embodiments, not shown, the coupling units 10 are embedded in the sign material 14 of the sign 8. In some embodiments, as shown in FIG. 1D, the coupling members 10 are embedded in a coupling member support 10 which is embedded in the material 14 of the sign 8.

As shown in FIGS. 1A and 1E, in some embodiments, the coupling area 3 is flush with or substantially flush with the face 2 of the road sign 8. FIG. 1E shows a bisected view of FIG. 1A along 1E-1E. As shown, in some embodiments, the masking material 12 is substantially flat at the transition from the coupling area 3 to the sign material 14.

As shown in FIG. 1E, the placard 4 can have coinciding coupling members 51 that pair with the coupling members 11 of the sign 8. As shown in FIG. 1C, the coupling members 11 of the sign 8 can be in an array. In some embodiments, the array comprises coupling members 11 arranged in recurring diamond shape, rectangular shape, square shape, triangle shape, rhomboidal shape (where each corner or vertices of an angular shape comprises a coupling member), in circular shape, and/or in an elliptical arrangement. The array of FIG. 1C is diamond shaped. In some embodiments, as disclosed elsewhere herein, the coupling members 51 of the placard 4 can be in an array (e.g., arranged in recurring or irregular (and not recurring) diamond arrangements, rectangular arrangements, square arrangements (where each corner of the shape is a coupling member) or in circular and elliptical arrangements). In some embodiments, the array of the sign 8 and the placard 4 substantially match.

FIG. 2A shows another embodiment of an adaptable sign. Throughout this disclosure, similar features for separate embodiments (e.g., main sections, coupling areas, etc.) can comprise one or more coinciding features offset numerically by a factor of 100 but having the same tens numerical value. For example, features of one embodiment of a road sign 8 can coincide to similar features of a different road sign 108 and can be offset by one hundred (e.g., features 1, 2, 3, and 4 coincide to features 101, 102, 103, and 104, respectively). In the interest of space, for some features, these numerical indicators may only be described for one embodiment, though they are applicable for any embodiment on which they are shown.

In some embodiments, as shown in FIG. 2A, the coupling area 103 of the sign face 102 is not substantially flush and the coupling area 103 resides in a recess 109 and/or is a recess 109. In some embodiments, as shown, the recessed coupling area 103 can comprise coupling features 111. In some embodiments, these coupling features 111 comprise one or more magnets 111, and/or one or more fasteners, and/or adhesives.

Figure 2D:
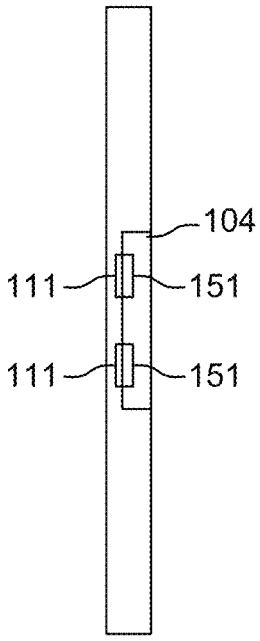
FIG. 2D is a cross-sectional view of the road sign of FIG. 2C.
Figure 3A:
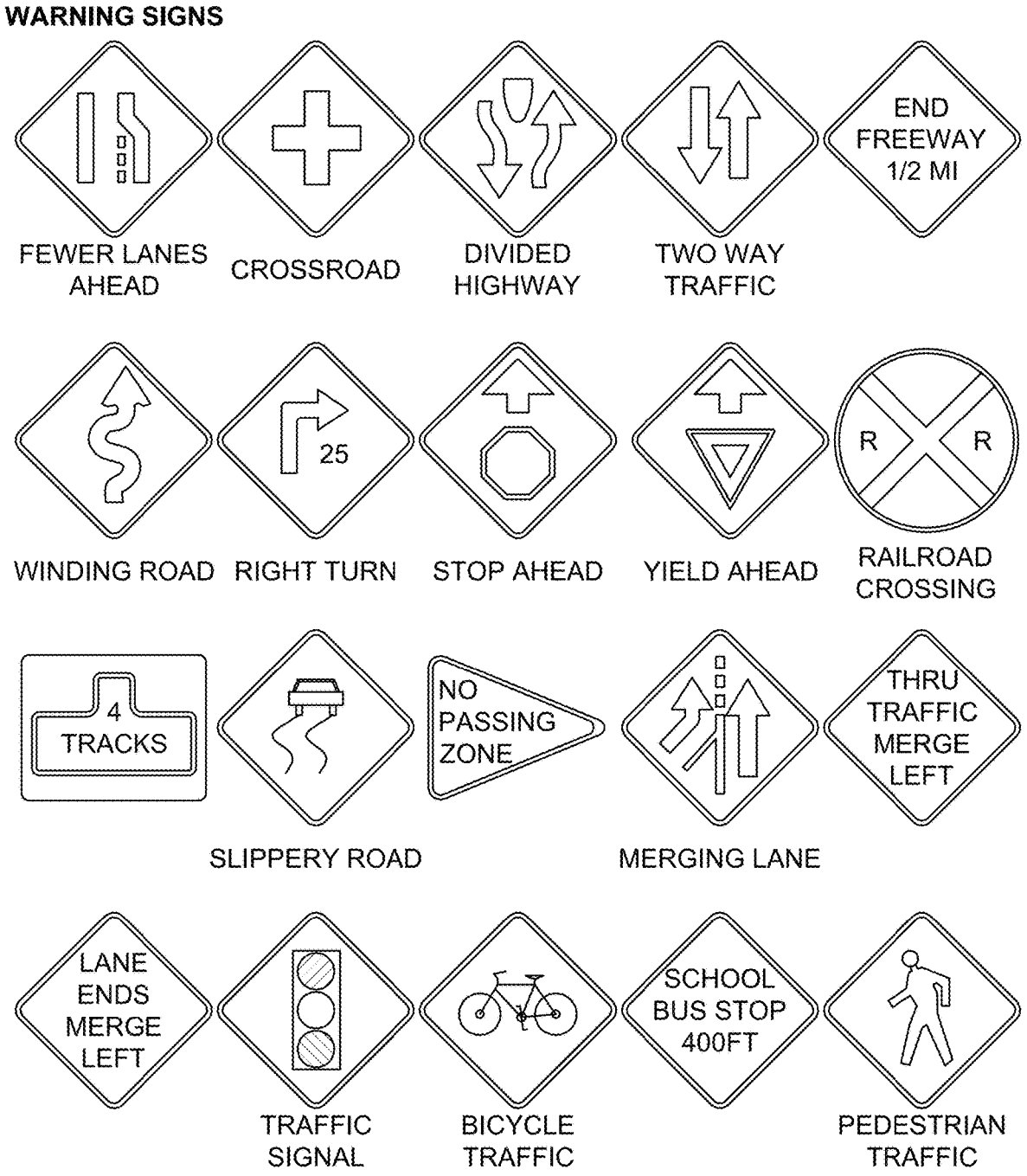
FIGS. 3A and 3B provide a list of drawings that can be placed on the placard and/or the sign face as indicators of road conditions or hazards.
Figure 3A:
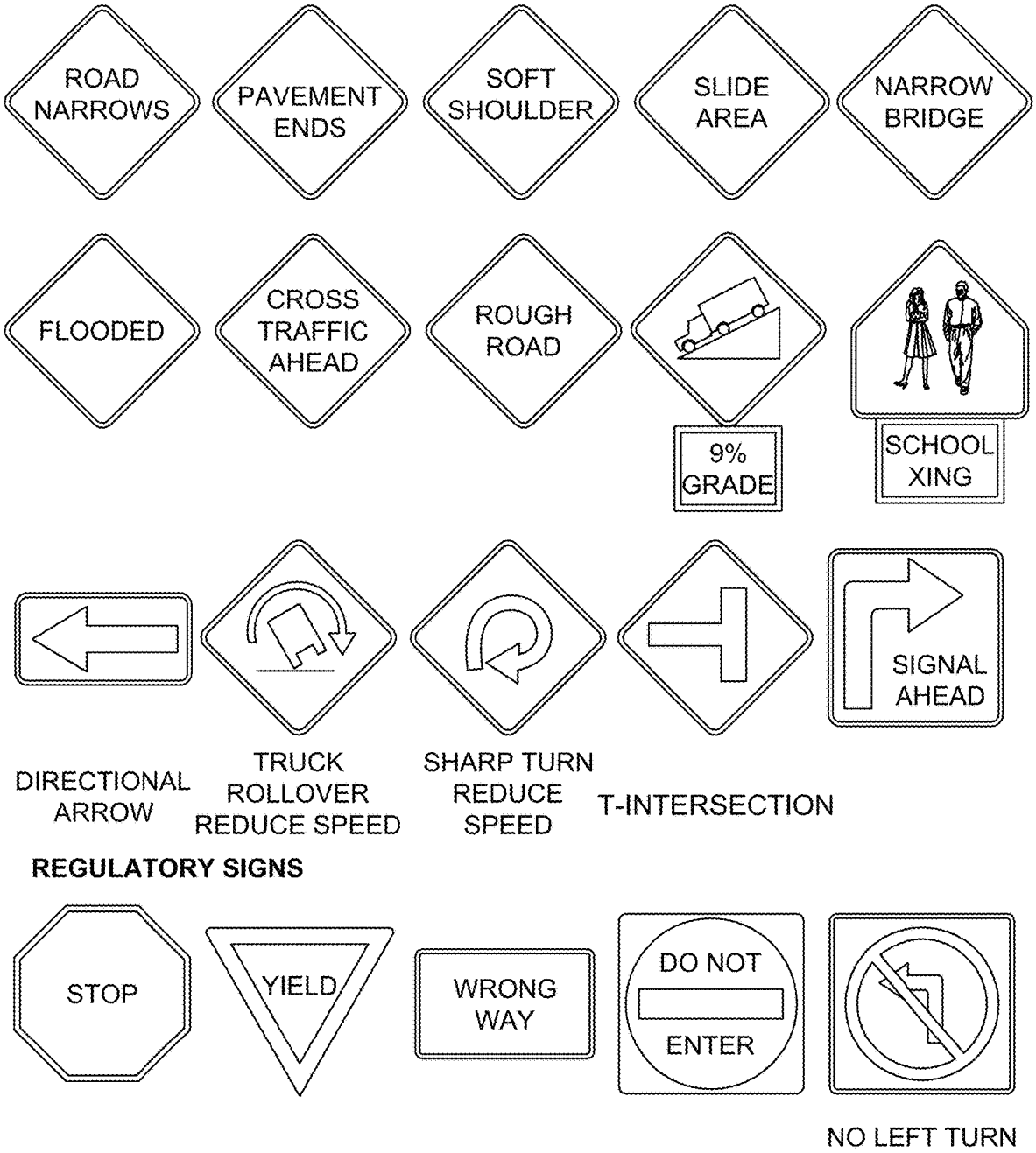
Figure 3A:
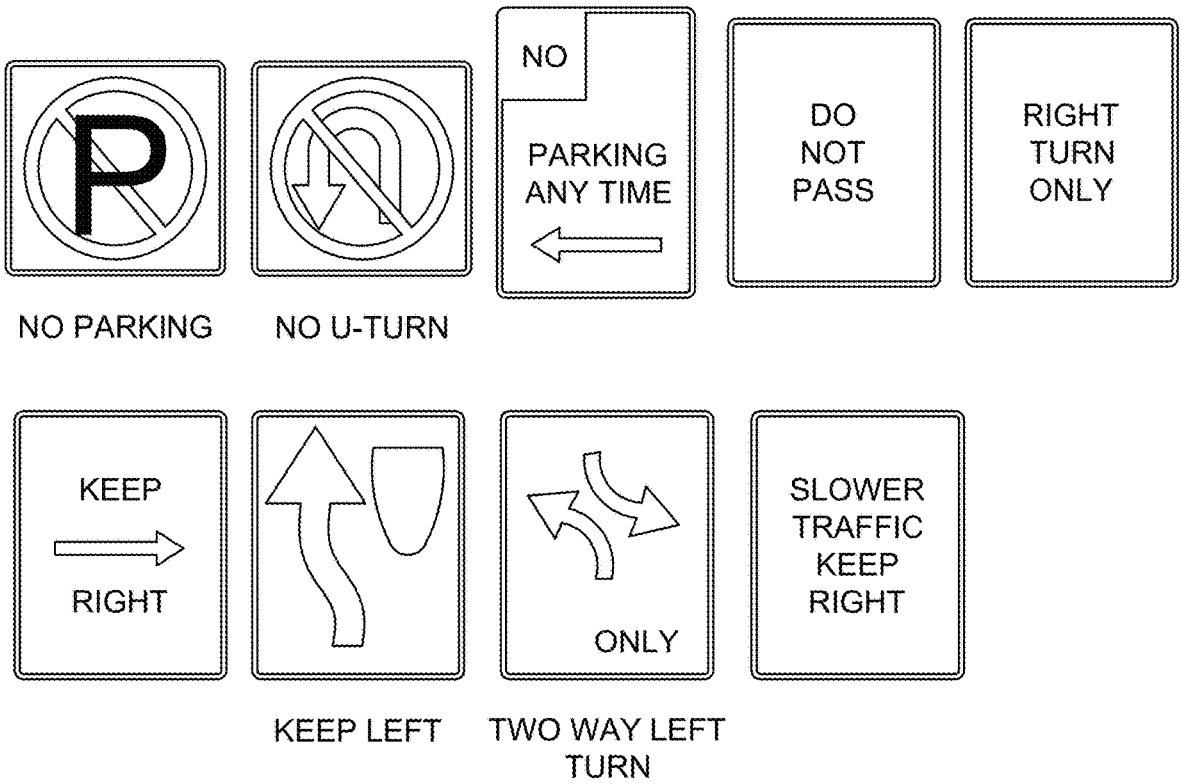
Figure 3B:
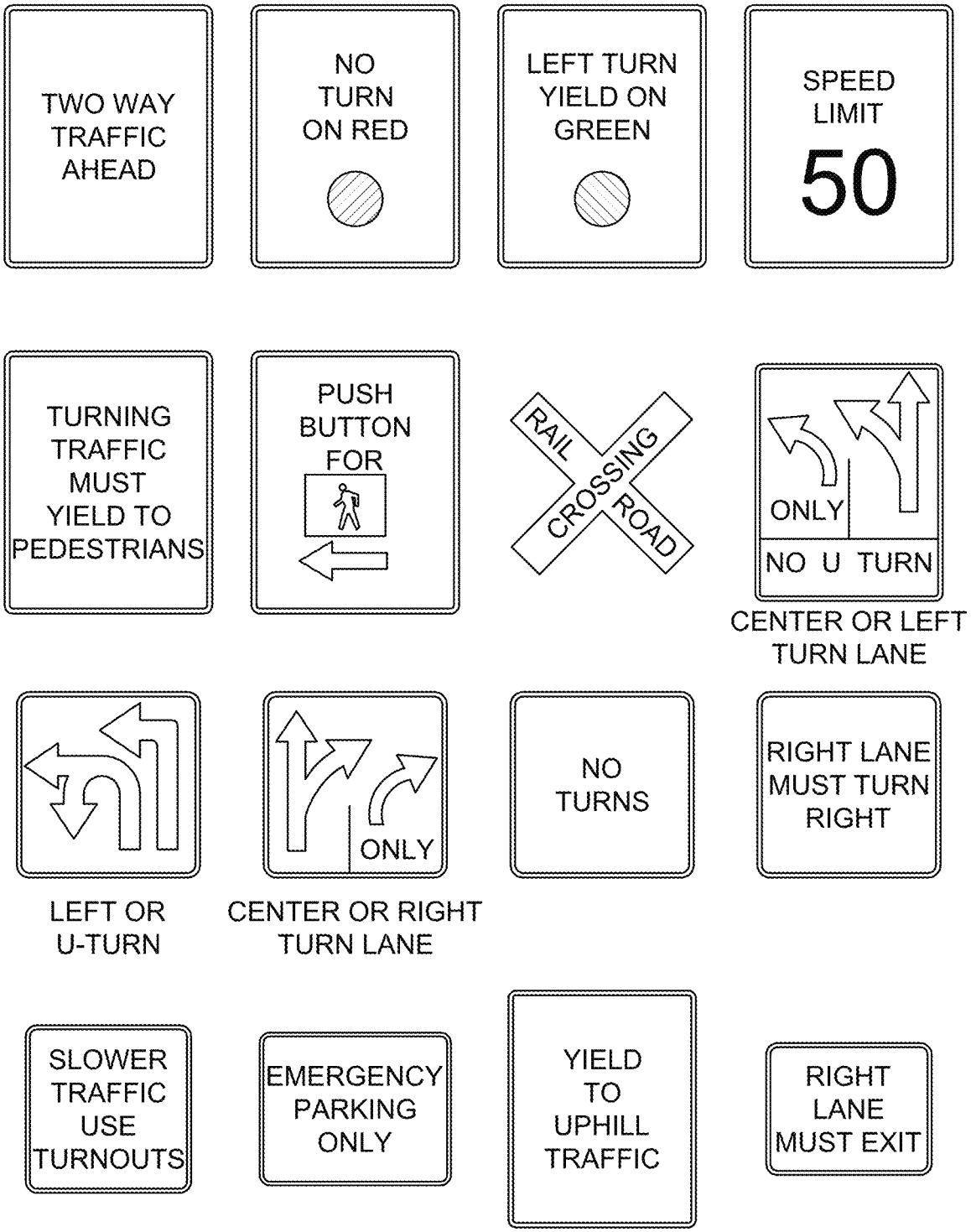
Figure 3B:
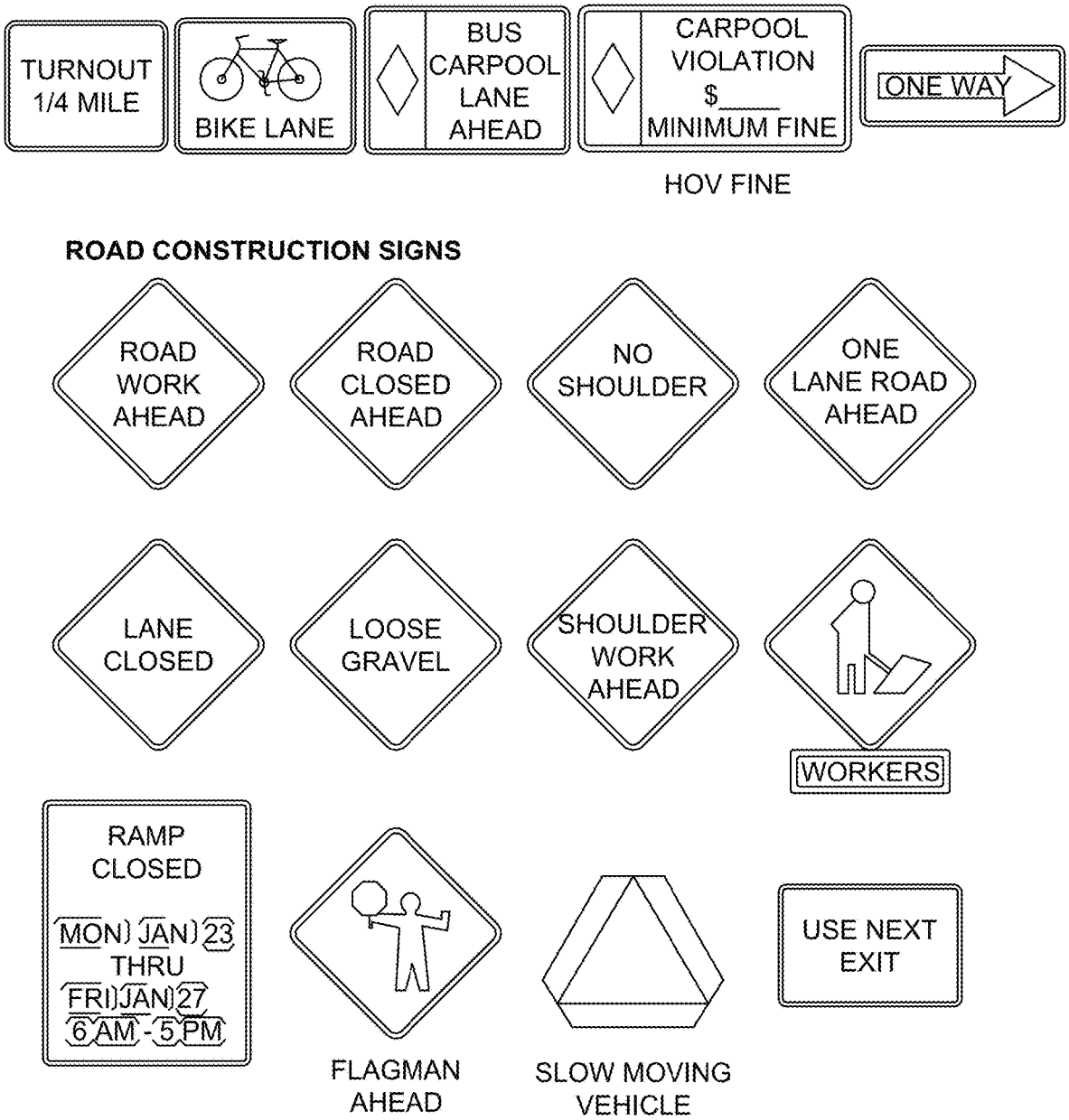
Figure 3B:
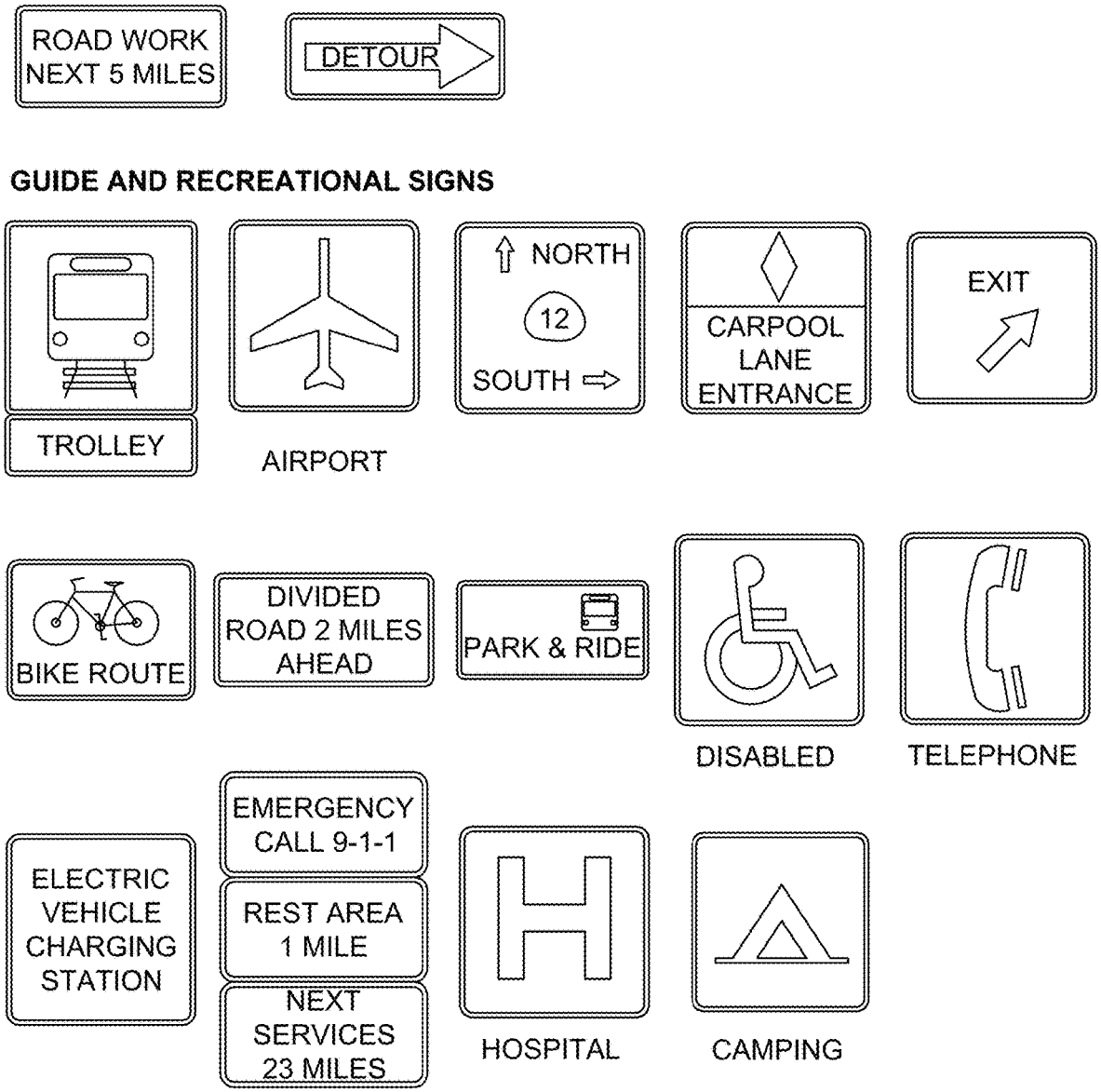

In some embodiments, as shown in FIG. 2D (a bisection along 2D-2D of FIG. 2C), the sign 108 can be substantially flush when the placard 104 is inserted into the recess 109 of the sign 108. In some embodiments, this configuration can advantageously prevents or lowers the occurrence of placard dislodgement from wind or contact. In some embodiments, the placard is configured to receive and/or comprises one or more locking mechanisms to make unauthorized tampering with the placard more difficult. In other embodiments, the placard sticks out from the sign face and is not flush with the sign face. In some embodiments, the placard provides a lip or protrusion from the sign face allowing access to the placard for easy exchange or replacement. In some embodiments, the placard shape coincides with and/or is smaller (to fit within) the recess shape. In some embodiments, as disclosed elsewhere herein, a recess is not present, which allows any shape placard to be placed on the sign (as opposed to ones fitting within the recess). In some embodiments, only some placards can fit on specific areas of the sign face.

In some embodiments, the recess 109 is positioned within the face 102 of the main section 101. In some embodiments, the recess 109 covers only a portion of the main section 101. In some variants, the recess has a depth that is less than or equal to about: ⅛ inches, ¼ inches, ½ inches, or ranges including and/or spanning the aforementioned values. In some embodiments, the placard has a thickness of less than or equal to about: ⅛ inches, ¼ inches, ½ inches, or ranges including and/or spanning the aforementioned values. In some embodiments, the sign has a thickness of less than or equal to about: ⅛ inches, ¼ inches, ½ inches, or ranges including and/or spanning the aforementioned values.

In some embodiments, as shown in FIG. 2A, the recess 109 is rectangular in shape. In some embodiments, the recess is square, circular, ellipsoidal, triangular, or another geometric shape. In some embodiments, the recess 109 is in a free-form shape (e.g., a shape having an irregular contour or any other shape that is not a geometric shape). In some embodiments, the shape and/or depth of the recess 109 can be adjusted either manually or by a machine.

As described elsewhere herein, the recess 109 can be a coinciding shape of the placard 104. Alternatively, the recess 109 may be configured to receive the placard 104 but may not be a coinciding shape of the placard 104. In some embodiments, the placard 104 is made from a bendable or flexible material that may bend, such that the recess 109 is configured to receive only a perimeter portion of the placard 104. In some embodiments, the placard 104 is made from a substantially rigid, inflexible material. In other embodiments, the recess 109 may be configured to receive the entire placard 104, but the placard 104 may bind or otherwise adhere to only a certain area of the recess 109 (and/or coupling area 3, 103). In some embodiments, the recess 109 may be configured to receive substantially all of the placard 104.

In some embodiments, the recess may only become configured to receive the placard 104 under certain conditions. For example, if the placard 104 is firmly pressed onto a portion of the main section 101 of the road sign 108 with sufficient force. In other embodiments, the recess 109 may only become configured to receive the placard 104 if it is within a specified temperature range (e.g., heated or cooled). In some embodiments, having a recess 109 that is configured to receive the placard 104 under particular conditions may confer additional advantages as compared to conventional road signs. For instance, some embodiments, may be less susceptible to manipulation by wild animals or passersby who are unauthorized to modify road signs. Temporarily configuring the recess 109 to receive a placard 104 can make it more difficult for unauthorized removal or accidental removal of the placard 104.

In some embodiments, as shown in FIGS. 1A and 2A, the main section 1, 101 of the sign 8, 108 can be in the shape of a diamond. In some embodiments, the main section can be any shape (e.g., a square, a circle, a rectangle, a triangle, a diamond, a trapezoid, a pentagon, or another geometric shape). In some embodiments, not shown, the main section can also be in a free-form shape (e.g., a shape having an irregular contour or any other shape that is not a geometric shape). In some embodiments, as shown, the main section 1, 101 has only one face 2, 102. In other embodiments, the main section has more than one face (e.g., is two-sided). In some embodiments, the main section is substantially flat. In some embodiments, the main section has a substantially planar surface. In some embodiments, the face of the road sign does not contain any slats, slits, joints, ledges, or tracks (e.g., does not include a track on which the placard is placed). In some embodiments, the road sign does not contain any ledges. In some embodiments, the face of the main section does not contain any holes. In some embodiments, the face of the main section does not contain any envelopes or pouches to hold the placard. In some embodiments, the face of the main section does not contain any hooks to hold the placard. In some embodiments, the road sign 8 does not contain a transparent overlay.

In some embodiments, the placard can be any shape (e.g., a square, a circle, a rectangle, a triangle, a diamond, a trapezoid, a pentagon, or another geometric shape). In some embodiments, the placard can also be in a free-form shape (e.g., a shape having an irregular contour or any other shape that is not a geometric shape). In some embodiments, the placard can be any shape, size, or color, which allows the placard to be customized to the specific design requirements of a particular type of road sign.

In some embodiments, the sign material of the main section is metal, plastic, or wood. In some embodiments, the main section is made from aluminum with a baked enamel finish. In some embodiments, the finish or masking of the main section is baked enamel. In some embodiments, the baked enamel has one side having a mill finish and the other side colored white (or another color as disclosed herein). In some embodiments, the masking material does not have any finish, or has a non-mill finish. In certain embodiments, the other side is another color. In some embodiments, the main section has a masking thickness of about: ⅛ inches, 1/16 inches, 1/32 inches, or ranges including and/or spanning the aforementioned values.

In some preferred embodiments, the main section is made from two sheets of 0.15 mm aluminum bonded to a solid polyethylene core, such that the main section is 3 mm thick. In such embodiments, the main section may have a baked enamel finish and one side of the main section may have a mill finish and the other side of the main section may have a white-colored finish.

In some embodiments, the main section 1 is configured to be supported by a sign stand (e.g., a tripod, a four-legged stand, etc.). Such sign stands include Signicade® portable sign stands, Signicade® deluxe sign stands, Signicade® MDX portable sign stands, Squarecade™ 45 sign stands—plain, Squarecade™ 36 sign stands—plain, Minicade® sign stands—plain, Minicade® sign stands 12"×24" EG striped sheeting, Minicade® sign stands 12"×24" HIP striped sheeting, Minicade® sign stands with sign legend, Narrowcade® with sign legend, Squarecade™ 45 sign stands with sign legend, Narrowcade® sign stands—plain, and heavy duty tripod sign stands. In some embodiments, the main section is configured to be supported by a sign stand with a springless base, a round base, a spring-loaded base, a solid base, a solid base, a fillable base, a ground stake base, an easel base, or a slipover base. In some embodiments, the main section is configured to be supported by a sign stand that comprises aluminum or steel. In some embodiments, the main section is configured to be supported by a sign stand that comprises plastic, rubber, wood, or a metal alloy. In some embodiments, the sign includes the sign stand.

In some embodiments, as shown in FIG. 1D, the main section 1 comprises a backing sheet of material 13. In some embodiments, a backing sheet of material is not present. The sheets of material 13 can be metal.

In some embodiments, the backing sheet and/or the sign material can be a material independently selected from standard calendared vinyl, premium cast vinyl, specialty vinyl, fabric, wind mesh, corrugated plastic, polystyrene, foam PVC, foam board, acrylic, polycarbonate, marine grade plywood (MDO), aluminum, aluminum composite materials (ACM) and combinations thereof. In some embodiments, the sheets comprise the same material. In some embodiments, the two sheets comprise different material.

In some embodiments, as shown in FIG. 1A, the masking material 12 of the face 2 comprises a different material from the sign material. In some embodiments, the face 2 and the main section 1 comprise the same material. In some embodiments, the face 2 comprises a visual indicator that comprises one or more of pictorial representations or a written language. In some embodiments, as described elsewhere herein, the pictorial representations of the visual indicator can include any one or more of the pictorial representations illustrated in FIG. 3. In some embodiments, written language on the sign can include any one or more of the following, including any individual word or letter of the following: "STOP"; "Truck Escape Ramp"; "Emergency Signal Ahead"; "Photo Enforced"; "No Train Horn"; "No Signal"; "Utility Work Ahead"; "Shoulder Work"; "Right Shoulder Closed"; "Right Two Lanes Closed ½ Mile"; "Exit Closed"; "Road Work Next 5 Miles"; "End Road Work"; "Slow Traffic Ahead"; "Construction Ahead"; "Construction Entrance"; "No Entrance"; "Road Construction Ahead"; "End Construction"; "No Construction Traffic"; "Heavy Truck Traffic"; "Construction Zone Speed Limit 10 MPH";

"Stop No Construction Traffic"; "Hard Hat Area"; "Speed Fines Doubled In Construction Zones When Workers Present"; "Under Construction"; "Give 'Em a Brake Slow Down"; "Accident Ahead"; "Raise Plow Ahead"; "Be Prepared To Stop"; "Slow Moving Vehicles"; "Watch For Falling Objects"; "Road Construction 1 Mile"; "Road Construction 1000 FT"; "Road Construction 1500 FT"; "Road Construction 250 FT"; "Road Construction 500 FT"; "Caution Manhole"; and "End Blasting Zone."

In some embodiments, as shown in FIG. 1C, the road sign 8 consists of two materials 13, 14 as sheets, etc. The materials 13, 14 can be made from Max-metal (e.g., two polyester pre-painted sheets of aluminum (about 0.15 mm thick) bonded to a solid, polyethylene core (that may be recycled)). In some embodiments, the materials are prepared of a substance (e.g., Max-metal) so that the sign is breakable to impact and has been approved by the Federal Highway Administration ("FHWA"). In some embodiments, the materials 13, 14 comprise material so that the sign can satisfy the relevant US federal and state requirements for construction sign and/or road sign safety.

In some embodiments, the placard and/or the sign is covered on both sides with reflective sheeting. The performance level of the reflective sheeting can be any of diamond grade, high intensity prismatic grade, advanced engineer grade, or engineer grade. In some embodiments, the reflective sheeting is diamond orange reflective sheeting (e.g., for main construction signs). In some embodiments, the reflective sheeting is high intensity prismatic reflective sheeting (e.g., for temporary regulatory white signs). The reflective sheeting material can be glass bead or flexible microplasmatic. In some embodiments, the placard comprises a different message on each side, so that the sign message can be changed by flipping the placard (see, e.g., FIG. 7C).

In some embodiments, the reflecting sheeting is made in accordance with any one or more of ASTM International's standard specifications. In some embodiments, the reflecting sheeting meets the ASTM D4956-04, ASTM D4956-13, or AASHTO M268-13 standards, as established by ASTM International. In some embodiments, however, the reflecting sheeting, does not fully or substantially comply with any of ASTM International's standards. Other reflective sheeting materials that may be used are listed in FIGS. 6A and 6B.

Figure 7A:
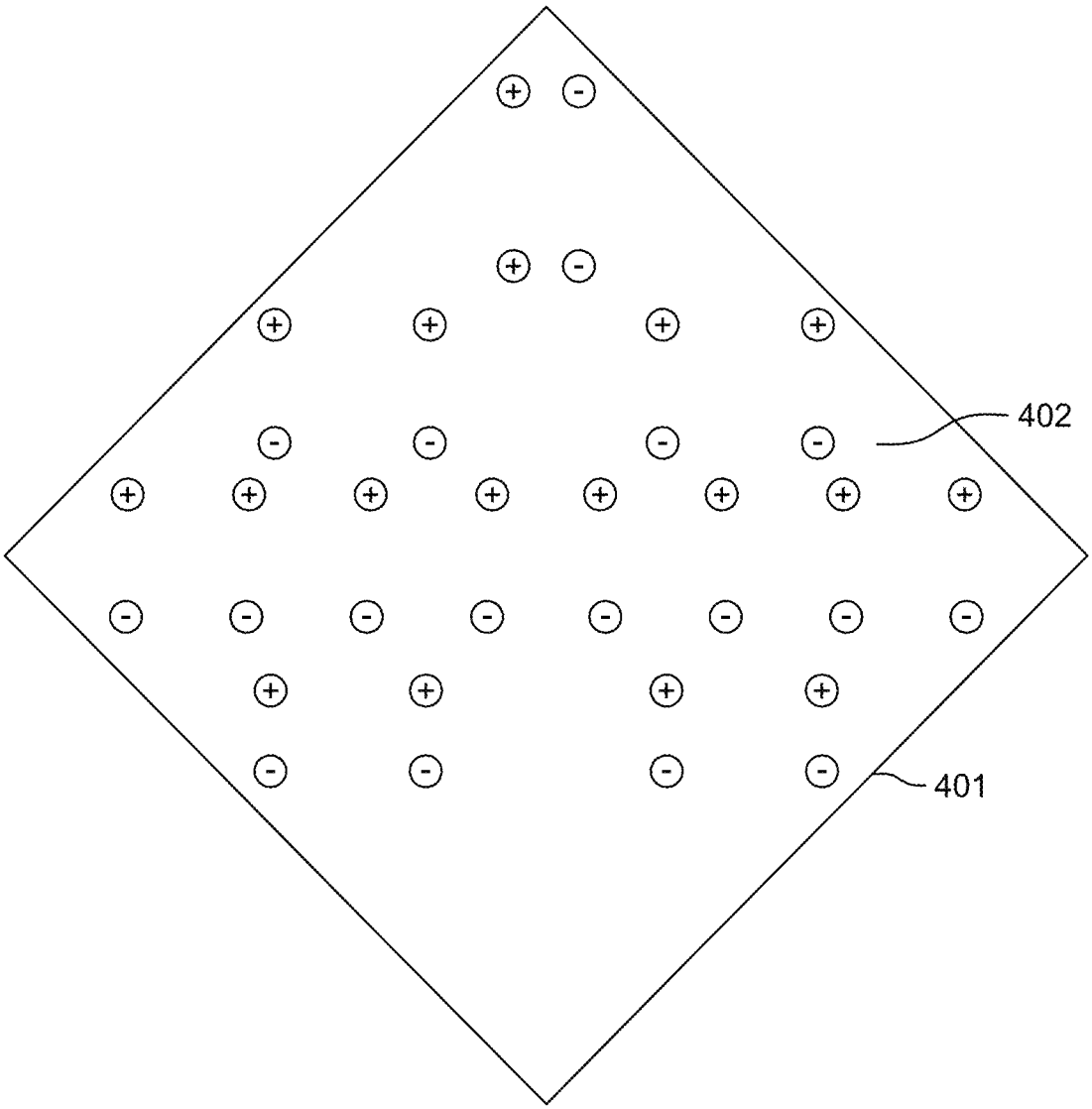
FIG. 7A is a front view of an embodiment of a road sign that illustrates an arrangement of magnets and indicates the polarity of each magnet.
Figure 7B:
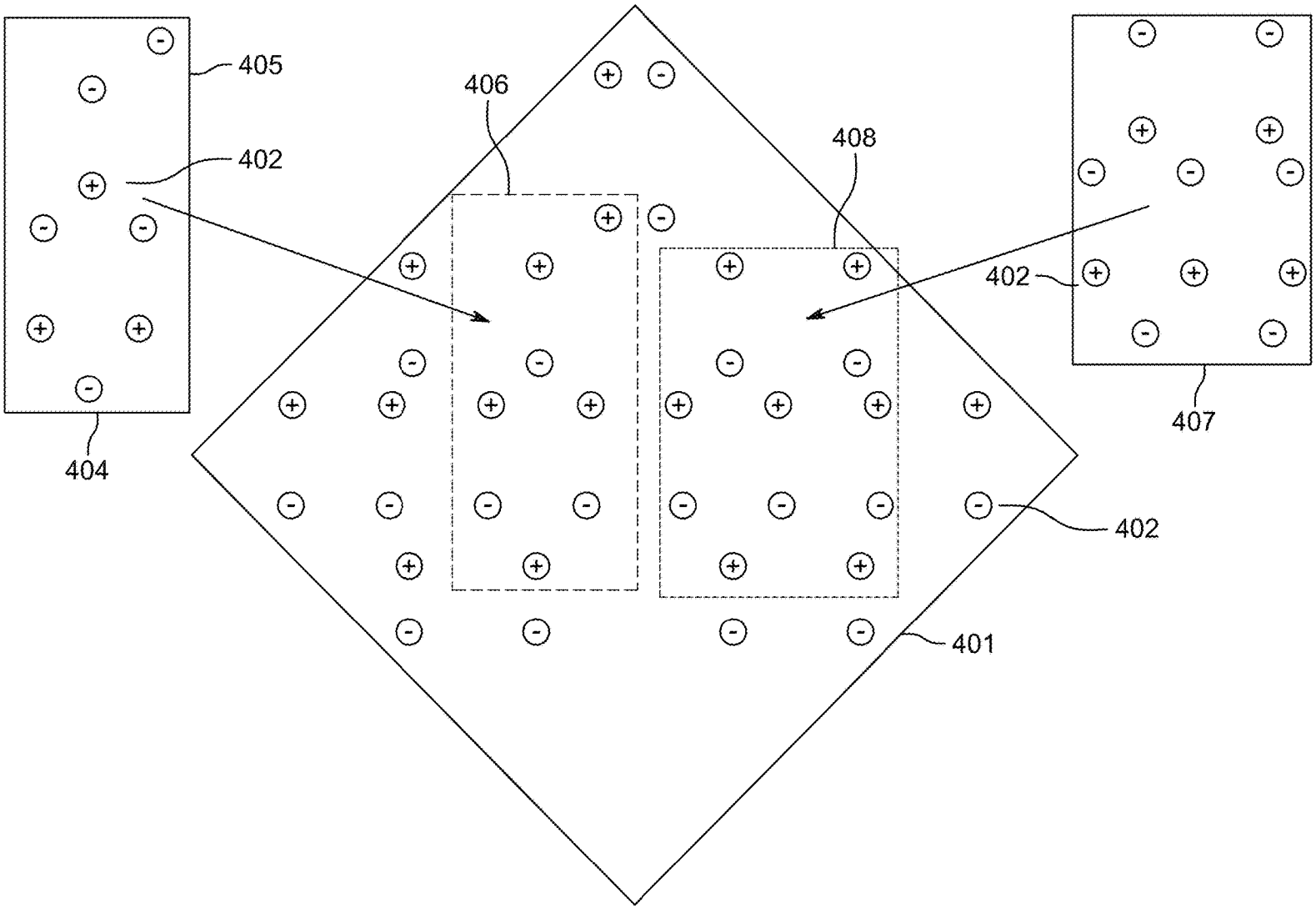
FIG. 7B is a front view of an embodiment of a road sign and two placards that illustrates arrangements of magnets on the sign and the two placards, along with their polarities.

In some embodiments, the coupling area 3, 103, has a coupling feature 11, 111. In some embodiments, the coupling area has more than one coupling feature. In some embodiments, the coupling feature can cover the entire coupling area. In some embodiments, the coupling feature covers less than the entire area of the coupling area. In some embodiments, where the coupling area has multiple coupling features, the coupling features can be of identical size and/or shape. In other embodiments, the coupling features vary in size and shape. In some embodiments, where the coupling area has multiple coupling features, the coupling features may be arranged in any pattern. FIGS. 7A and 7B show two such patterns.

In some embodiments, as shown in FIGS. 7A and 7B, the coupling feature includes one or more magnets 11. The material of the magnets 11 can include one or more of neodymium iron boron, samarium cobalt, alnico, ceramic, ferrite, and iron nitride. In some embodiments, the material of the magnets is neodymium iron boron. In some embodiments, the magnets are selected from only one of these materials. In other embodiments, the magnets are selected from more than one of these materials. In some embodiments, the material of the magnets is selected from one or more of a variety of rare earth elements (i.e., Scandium, Yttrium, Lanthanum, Cerium, Praseodymium, Neodymium, Promethium, Samarium, Europium, Gadolinium, Terbium, Dysprosium, Holmium, Erbium, Thulium, Ytterbium, Lutetium).

In some embodiments, as shown in FIGS. 7A and 7B, the magnets 402 are positioned in an array on the main section 1, 401. In some embodiments, the array can be configured such that the magnets 402 are positioned in evenly spaced rows or columns. The array can also be configured such that the magnets 402 are positioned according to other geometric patterns (as shown in FIG. 7A). In other embodiments, the magnets 402 are positioned according to free-form patterns. In some embodiments, the magnets are arranged in an array of rows and columns, with two rows and three columns.

In some embodiments, the magnetic force that adheres the placard to the face of the main section is sufficiently strong so that the placard does not require any additional support (e.g., lip, rail, ledge, edge) to remain adhered to the face of the main section. In some embodiments, the magnetic force that adheres the placard to the face of the main section is sufficiently strong and additional support features (e.g., lip, rail, ledge, edge) are absent and/or the face of the sign lacks such features. In other embodiments, additional supports can be used in addition to the magnetic force to ensure that the placard remains adhered to the face of the main section.

In some embodiments, the coupling feature includes one or more magnets 11 (also referred to as a plurality of magnetic features) configured in an array. In some embodiments, some or all of the magnets in the array form points (e.g., vertices) on a polygon (e.g., a square, a rectangle, a triangle, a diamond, a trapezoid, a pentagon, or another geometric shape). For example, in some embodiments, the array includes groups of three magnets, each group arranged as points on a triangle. In some embodiments, some or all of the magnets in the array are not arranged in a way that resembles points on a polygon. In some embodiments, the polygon is a triangle, a square, a trapezoid, a rectangle, or a pentagon. In some embodiments, some or all of the magnets in the array are arranged according to their polarity (e.g., a magnet has a positive (north) or negative (south) pole). In some embodiments, the polarity as disclosed herein refers to the side of the magnet directed toward a surface of the sign or placard in which the magnet is embedded. In some embodiments, it is through this surface that the magnet interacts with a magnet having an opposite polarity. In some embodiments, a polygon of the sign face (or of the placard) can have magnets of one polarity. In some embodiments, for any given polygonal arrangement of magnets in the sign face (or in the placard), at least one magnet has a different polarity from the other magnets at the vertices of the polygon. In some embodiments, for any given polygonal arrangement of magnets in the sign face (or in the placard), at least two magnets have a different polarity from the other magnets at the vertices of the polygon. In some embodiments, the ratio of positive to negative polarity magnets in a polygonal arrangement in the sign face (or in the placard) is equal to or at least about: 1:5, 1:4, 1:3, 1:2, 1:1, 2:1, 3:1, 4:1, 5:1, or ranges including and/or spanning the aforementioned ratios. In some embodiments, some of the magnets in the array form points on a line segment.

In some embodiments, the magnets, the sign face, and the placard have a surface area along the substantially flat portions of their surfaces. In some embodiments, the surface area of the placard covered by magnets is less than or equal to than the surface area of the placard that is not covered by magnets. In some embodiments, the surface area of the sign face that is covered by magnets will be less than or equal to the surface area of the placard that is not covered by magnets. In some embodiments, the surface area of the placard covered by magnets will be greater than the surface area of the placard that is not covered by magnets. In some embodiments, the surface area of the sign face that is covered by magnets will be greater than the surface area of the placard that is not covered by magnets. In some embodiments, the percentage of the surface area of the placard that is covered by magnets is equal to or at least about: 10%, 25%, 40%, 50%, 60%, 75%, 85%, or ranges including and/or spanning the aforementioned percentages. In some embodiments, the percentage of the surface area of the sign face that is covered by magnets is equal to or at least about: 2%, 5%, 10%, 15%, 20%, 30%, 35%, 40%, or ranges including and/or spanning the aforementioned percentages.

In some embodiments, the percentage of the surface area of the placard that exerts attractive magnetic forces is equal to or at least about: 5%, 15%, 25%, 35%, 50%, 70%, 85%, 95%, or ranges including and/or spanning the aforementioned percentages. In some embodiments, the percentage of the surface area of the sign face that exerts attractive magnetic forces is equal to or at least about: 5%, 15%, 25%, 35%, 50%, 70%, 85%, 95%, or ranges including and/or spanning the aforementioned percentages.

Figure 7C:
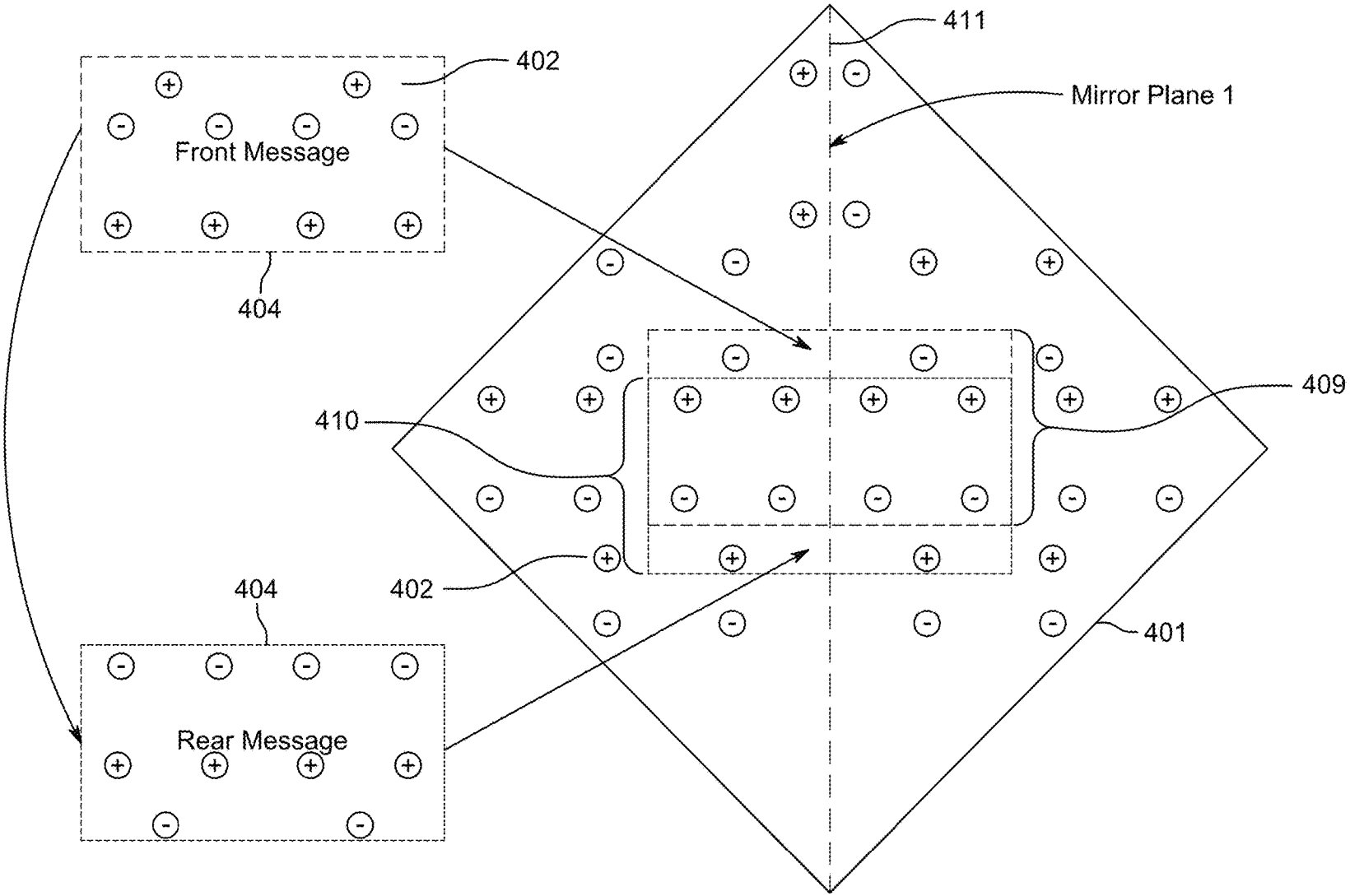
FIG. 7C is a front view of an embodiment of a road sign and front and rear views of a single placard that illustrates arrangements of magnets on the sign and the placard, along with their polarities.

In some embodiments, some or all of the magnets in the array are configured so that the placard can adhere to the face of the main section only when the placard is in an upright position (i.e., in a position in which the message is displayed in an upright position so that passersby can read it). For example, as shown in FIGS. 7B and 7C, in some embodiments, the polarities of the some or all of the magnets in the array are configured to match (and/or coincide with) the polarities of the placard (e.g., where positive on the sign is matched with negative on the placard and vice versa), so that the placard must be in an upright position in order to adhere to the face of the main section. Alternatively, this mixing and matching of polarities can be used to repel placards that are incorrect or incorrectly positioned.

As shown in FIG. 7B, configurations of magnets 402 can be provided so that only specific combinations of placards 404 can be placed on the sign face 401 at one time. For example, as shown in FIG. 7B, in some embodiments, a first placard 405 with a first array of magnets couples to a first area 406 of the sign face having an array of magnets coinciding to the first array. In some embodiments, a second placard 407 with a second array of magnets couples to a second area 408 of the sign face having an array of magnets coinciding to the second array of magnets. In some embodiments, the first area 406 of the sign face does not couple with and/or repels a placard having the second array of magnets. In some embodiments, the second area 408 of the sign face does not couple with and/or repels a placard having the second array of magnets. Other placard pairs can be configured in similar ways so that they may only be paired with correct mates.

In some embodiments, some or all of the magnets in the array are configured so that the placard may adhere to the face of the main section when the placard is in one of multiple different positions. In some embodiments, the magnetic array of the placard and the coinciding array of the sign face may comprise regular patterns (e.g., a grid) of like polarity magnets that allows any placard to be placed on the sign face in multiple locations. In some embodiments, these allow a variety of combination messages to be made.

As shown in FIG. 7C, configurations of magnets 402 can be provided on the main section 401 so that either side of a single placard may adhere to the main section 401. This allows a single placard 404 to be flipped over to display an entirely new message to passersby. For example, as shown in FIG. 7C, a placard 404 may be placed on a first area 409 with a first array of magnets to display a front message and may be flipped and then placed on a second area 410 with a second array of magnets to display a rear message. FIG. 7C shows two sides of a single placard. The top image is a frontal view of the side of the placard 404 that is to adhere to the first area 409 to display a "front message." The bottom image is a frontal view of the side of the placard 404 that is to adhere to the second area 410 to display a "rear message." The front message is displayed on the side of the placard 404 not shown in the top image; likewise, the rear message is displayed on the side of the placard 404 not shown in the bottom image. In some embodiments, as illustrated in FIG. 7C, the first area 409 and the second area 410 are not coinciding. In some embodiments, the first area 409 and the second area 410 overlap. In some embodiments, the first area 409 and the second area 410 do not overlap at all.

As shown in FIG. 7C, configurations of magnets 402 can be provided on the main section 401—as well as the placards 404—so that there is vertical symmetry. For example, as shown in FIG. 7C, the main section 401 has a line of vertical symmetry (also referred to as a "Mirror Plane 1" in the figure). In some embodiments, the arrays of magnets on the main section 401, the placards 404, or both are asymmetric.

In some embodiments, the coupling features 11 (e.g., magnets) have various dimensions. The diameter of each coupling feature (e.g., magnet) can be less than or equal to about: ⅛ inch, ½ inch, 1 inch, 2 inches, or ranges including and/or spanning the aforementioned values. The height of each magnet (or other coupling feature) can be less than or equal to about: 1/16 inch, ⅛ inch, ½ inch, or ranges including and/or spanning the aforementioned values. In some embodiments, each of the magnets (or other coupling feature) has a dimension of ½×⅛ inches (12.7×3.2 mm). In some embodiments, each of the magnets is made of neodymium iron boron, grade N48. In some embodiments, the magnets are magnetized axially. For example, the magnetization is directed axially, such that the poles are on each of the flat ends of the disc, respectively. In some implementations, the magnetization direction is equatorial. In other variants, the magnetization extends radially outward toward to opposite ends of the magnet, but neither axially nor equatorially. In some embodiments, the area of the coupling features is less than half the dimensional area of the area of the coupling area.

In some embodiments, the weight of each of the magnets is less than or equal to about: 0.05 oz, 0.06 oz, 0.07 oz, 0.08 oz, 0.09 oz, 0.10 oz, 0.11 oz, 0.12 oz, 0.13 oz, 0.14 oz, 0.15 oz, or ranges including and/or spanning the aforementioned values. In some embodiments, the weight of each of the magnets is 0.106 oz.

In some embodiments, the ratio of the size (e.g., mass, volume) of each magnet relative to the distance between any two magnets is sufficient so that the magnets do not interfere with the coupling of any of the magnets of the same polarity located on the placard, wherein the magnets are sufficiently close to one another to allow tight binding between the placard (e.g., an array of magnets embedded in the placard) and the array on the face of the main section.

In some embodiments, the shape of the magnets (or other coupling features) can be either uniform or varied. As illustrated by FIGS. 1C and 1D, in some embodiments, the magnets may be disc-shaped or circular. Each magnet (or other coupling feature), however, can, in some embodiments, be in any shape, including geometric shapes and free-form shapes (e.g., a shape having an irregular contour or any other shape that is not a geometric shape). In some implementations, the shape of the magnets (or other coupling features) is that of a rectangular prism, cube, triangular prism, octagonal prism, triangular pyramid, square pyramid, cylinder, cone, or sphere. In some embodiments, each of the magnets 11 (or other coupling features) is of the same type of shape. In some embodiments, the magnets 11 (or other coupling features) are in various shapes. In some embodiments, the height of the magnets is/are less than or equal to the thickness of the road sign 8.

In some embodiments, the one or more magnets 11 (or other coupling features) are positioned within the road sign 8 such that a surface of the one or more magnets 11 (or other coupling features) is substantially flush with a surface of the coupling area 3. In some embodiments, the one or more magnets 11 (and/or other coupling features) are configured to be adjusted manually (e.g., by-hand and/or without tools) into a position within the road sign 8 such that a surface of the one or more magnets 11 (or other coupling features) is substantially flush with a surface of the coupling area 3. In some embodiments, the one or more magnets 11 (or other coupling features) are positioned permanently. In some embodiments, the one or more magnets 11 (or other coupling features) are positioned within the road sign 8 such that a surface of the one or more magnets 11 (or other coupling features) is not flush with a surface of the coupling area 3.

As disclosed elsewhere herein, in some embodiments, a plurality of magnetic features is provided on a sign, including 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, or ranges including and/or spanning the aforementioned values, or more. In some embodiments, the number of features provided on and/or within the sign face is less than or equal to about: 10, 20, 40, 70, 100, 130, 160, 190, 200, 220, or ranges including and/or spanning the aforementioned values, or more. In some embodiments, the one or more magnets 2, 4, 8, 12, 16, 22, 28, 32, 34, or ranges including and/or spanning the aforementioned values. In some embodiments, the number of the one or more magnets 11 is 36. In some embodiments, the number of magnets 11 provided is less than or equal to 200. Having a greater number of magnets confers certain advantages, including, e.g., further increasing the adaptability of the sign and placards.

In some embodiments, as disclosed elsewhere herein, the coupling area comprises one or more fasteners. In some embodiments, the fasteners are wood screws, machine screws, thread cutting machine screws, sheet metal screws, self-drilling SMS, hex bolts, carriage bolts, lag bolts, socket screws, eye bolts, eye lags, J-bolts, U-bolts, shoulder bolts, elevator bolts, sex bolts, mating screws, or hanger bolts. The fasteners can be on any one or more of the placard, the sign, and the sign stand. In certain implementations, the head style of each fastener is flat, oval, pan, truss, round, hex, hex washer, slotted hex washer, socket cap, or button. In each of these embodiments, the one or more fasteners are configured to be received by the main section 1, as illustrated in FIG. 1A. Further, the one or more fasteners are configured to be received by the placard 4, which in some embodiments, has a plurality of holes to receive the one or more fasteners. In some embodiments, the fasteners are positioned in an array of rows and columns. In some embodiments, the fasteners are positioned in an array of two rows and three columns. In some embodiments, the fasteners (e.g., magnets) are positioned in an array comprising greater than or equal to about: 2 rows, 3 rows, 4 rows, 5 rows, 10 rows, 15 rows, 20 rows, or ranges including and/or spanning the aforementioned values. In some embodiments, the fasteners (e.g., magnets) are positioned in an array comprising greater than or equal to about: 2 columns, 3 columns, 4 columns, 5 columns, 10 columns, 15 columns, 20 columns, or ranges including and/or spanning the aforementioned values. In some embodiments, each placard 4 is rectangular, having a plurality of holes with one hole at each corner.

In some embodiments, the coupling area includes one or more adhesives. In some embodiments, the adhesive comprises one or more of a rubber adhesive, an anaerobic adhesive, a cyanoacrylate adhesive, an epoxy adhesive, a polyurethane adhesive, a phenolic adhesive, a silicone adhesive, a polyimide adhesive, a polyvinyl acetate adhesive, a pressure-sensitive adhesive. Where the coupling feature comprises one or more adhesives, the adhesives are, in some embodiments, pressure-sensitive or another type of adhesive that does not solidify to form a solid material.

In some embodiments, the fastener comprises one or more of a hook, a strap, a peg, a hanging wire, a clasp, a clamp, and a hook-and-loop fastener.

In some embodiments, as disclosed elsewhere herein, the coupling area includes a combination of one or more magnets, one or more fasteners, and one or more adhesives. The magnets, fasteners, and adhesives can be positioned in an array as described elsewhere herein (e.g., in rows, forming shapes, etc.). For example, a first top row may comprise evenly spaced magnets. A second middle row may comprise evenly spaced fasteners. A third bottom row may comprise one or more adhesives arranged substantially horizontally. In some embodiments, the magnets, fasteners, and adhesives may be arranged in a non-geometric pattern, such as according to a free-form design (e.g., a shape having an irregular contour or any other shape that is not a symmetric geometric shape).

In some embodiments, as disclosed elsewhere herein, the placard adheres with enough strength to pass highway safety ratings for conventional road signs. In some embodiments, the placard is adhered to the main section of the sign with enough strength to remain adhered when the sign is exposed to a sustained sheering wind speed of equal to or at least about: 40 mph, 60 mph, 70 mph, 80 mph, 100 mph, or ranges including and/or spanning the aforementioned values. In some embodiments, the placard is adhered to the main section of the sign with enough strength to remain adhered when the sign is exposed to a sheering wind gust speed of equal to or at least about: 70 mph, 80 mph, 90 mph, 100 mph, 120 mph, or ranges including and/or spanning the aforementioned values. In some embodiments, the placard is adhered to the main section of the sign with enough strength such that the placard remains adhered during an impact with a motor vehicle traveling at a speed of less than or equal to about: 20 mph, 30 mph, 40 mph, 60 mph, 70 mph, 80 mph, 100 mph, or ranges including and/or spanning the aforementioned values. In some embodiments, the placard is adhered to the main section of the sign when the sign is exposed to a sheering gust wind or gust via a grip strength that is equal to or at least about: 5.0 lbs/sq. ft, 10.0 lbs/sq. ft, 15.0 lbs/sq. ft, 20.0 lbs/sq. ft, 25.0 lbs/sq. ft, 30.0 lbs/sq. ft, 35.0 lbs/sq. ft, or ranges including and/or spanning the aforementioned values. In some embodiments, the placard is adhered to the main section of the sign when the sign is exposed to a sheering gust wind or gust via a grip strength that is 30 lbs/sq. ft.

In some embodiments, the placard adheres to the main section via magnetic force and the pull strength of the magnet(s) is equal to or at least about: 1.0 lbs, 2.0 lbs, 3.0 lbs, 5.0 lbs, 6.5 lbs, 8.0 lbs, 9.5 lbs, 11.0 lbs, 12.5 lbs, 14.0 lbs, 15.5 lbs, 17.5 lbs, 19.0 lbs, 20 lbs, 22 lbs, 25 lbs, or ranges including and/or spanning the aforementioned values. In some embodiments, the pull strength of the magnet(s) is equal to or at least about: 2.0 lbs, 5.0 lbs, 8.0 lbs, 11.0 lbs, 14.0 lbs, 15.5 lbs, or ranges including and/or spanning the aforementioned values. In some embodiments, the "single strength" (e.g., the pull strength of a single magnet) is equal to or at least about 7.5 lbs. In some embodiments, the "coupled strength" (e.g., the pull strength generated by two magnets coupled to one another) is equal to or at least about 15.0 lbs.

In some embodiments, a method of manufacturing a road sign is provided. The method can include providing a main section. In some embodiments, the main section comprises a face having a coupling area. In some embodiments, the coupling area is provided by adding one or more coupling features to the sign. The method can include attaching the main section to a support structure. In some embodiments, the support structure comprises a sign stand.

Figure 4:
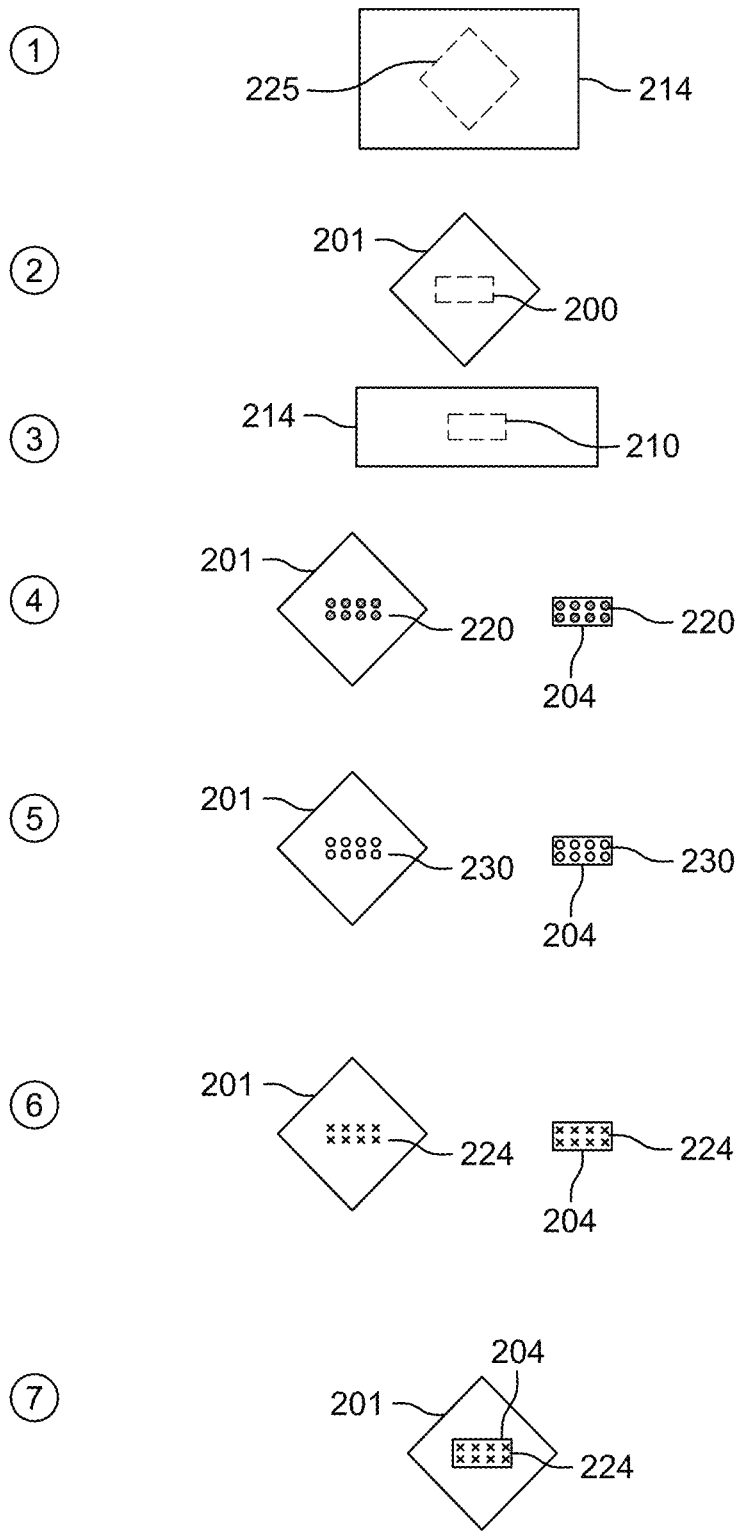
FIG. 4 illustrates a method of manufacturing an embodiment of a road sign.

FIG. 4 shows an embodiment of a method of manufacturing an adaptable road sign. Throughout this disclosure, similar features for separate embodiments (e.g., main sections, coupling areas, etc.) can comprise one or more coinciding features offset numerically by a factor of 100 but having the same tens numerical value. For example, features of one embodiment of a road sign 8 can coincide to similar features of a different road sign 108 and can be offset by one hundred (e.g., features 1, 2, 3, and 4 coincide to features 101, 102, 103, and 104, respectively). In the interest of space, for some features, these numerical indicators may only be described for one embodiment, though they are applicable for any embodiment on which they are shown.

In some embodiments, a method of making a sign is provided. FIG. 4 demonstrates an embodiment of a method for making a sign. Any one or more of these steps can be excluded. In some embodiments, as shown in FIG. 4, the method comprises a step of drawing an outline 225 of the desired shape of the main section 1, 101, 201 on a sign material 14, 214. In some embodiments, as shown in FIG. 4, the method comprises a step of cutting the main section 1, 201 from the sign material 14, 214 (e.g., according to an outline 225). As shown, in some embodiments, the method comprises a step of drawing an outline 200 of the desired shape of the placard 4, 204 on the main section 1, 101, 201. In some embodiments, the method comprises a step of drawing an outline 210 of the desired shape of the placard 4, 104, 204 on a sign material 214. In some embodiments, the method comprises a step of cutting the placard 4, 104, 204 from the sign material 14, 214 according to the outline 210. In some embodiments, the method comprises a step of drawing a plurality of points 220 on both the placard 204 and the main section 201. In some embodiments, the plurality of points 220 can include one or more points. In some embodiments, as shown in FIG. 4, the method comprises a step of cutting a plurality of holes 230 in the main section 1, 201 according to the locations of the plurality of points 220. The plurality of holes 230 can include one or more holes. In some embodiments, the method comprises a step of attaching one or more coupling features 24, 224 to both the main section 1, 201 and the placard 4, 204 by adhering them, or otherwise attaching them, to the plurality of holes 230. In some embodiments, as shown, the method comprises a step of attaching the placard 4, 204 to the main section 1, 201 by means of the one or more coupling features 224.

In some embodiments, the steps are not all performed in the order as shown in FIG. 4. For example, the plurality of points 220 may be drawn on the main section 1, 201 before the placard 4, 204 is cut from the sign material 14, 214. As another example, the one or more coupling features 224 may be attached to the main section 1, 201 before cutting the plurality of holes 230 into the placard 4, 204.

In some embodiments, as shown in FIG. 4, after an outline 225 of the desired shape of the main section 1, 201 is drawn on the material 14, 214, the resulting main section 1, 201 is substantially or completely in accordance with the outline 225 that was drawn. In some embodiments, the resulting main section 1, 201 is not substantially or completely in accordance with the outline 225. In some embodiments, the outline 225 is proportional to, but does not coincide with, the shape of the resulting main section 1, 201.

In some embodiments, no outline is drawn. For example, the manufacturer may cut the sign material without using any visual aid, computerized system, or any other aid to cut the sign material to produce the desired shape of the main section. In some embodiments, an outline, similar to the outline 225 as shown in FIG. 4, is created using lighting. One advantage of using a temporary means of creating the outline, such as marks that are erasable or a type of lighting, is that there is a decreased risk that the resulting main section will have undesirable leftover markings.

In some embodiments, as shown in FIG. 4, the material 14, 214 is cut along the outline 225 using manual (e.g., by-hand and/or without tools) technologies. Such technologies for cutting the metal or sign material include using a saw, chisel, shear or snips. In some embodiments, the material 14, 214 is cut using machine technologies. Such technologies include turning, milling, drilling, grinding, and sawing. In some embodiments, the material 14, 214, as shown, is cut using welding or burning technologies. Such technologies include using a laser, oxy-fuel burning, and plasma. In some embodiments, the material 14, 214 is cut using erosion-based technologies. Such technologies include using a water jet, electric discharge, and abrasive flow machining. In some embodiments, the material 14, 214 is cut using chemical technologies. Such technologies include photochemical machining.

In some embodiments, as shown in FIG. 4, after the main section 1, 201 is cut from the material 14, 214, an outline 200 is created on the main section 1, 201. In some embodiments, the outline 200 is drawn by hand, displayed, or otherwise created in accordance with the desired shape of the placard 4, 204. In some embodiments, the outline 200 is substantially or completely in accordance with the desired shape of the placard 4, 204. In some embodiments, the outline 200 is proportional to, but does not coincide with the desired shape of the placard 4, 204.

In some embodiments, as shown in FIG. 4, an outline 210 is drawn, displayed, or otherwise created on the material 14, 214. In some embodiments, the outline 210 is drawn displayed, or otherwise created on the material 14, 214 in the desired shape of the placard 4, 204. In some embodiments the outline 210 is substantially or completely in accordance with the desired shape of the placard 4, 204. In some embodiments, the outline 200 is proportional to, but does not coincide with the desired shape of the placard 4, 204.

In some embodiments, as shown in FIG. 4, a plurality of points are drawn, displayed, or otherwise created on the main section 1, 201 and on the placard 4, 204. The plurality of points can be, in some embodiments, positioned on both the main section 1, 201 and the placard 4, 204 to reflect the desired positions of the coupling features 24, 224. In some embodiments, the plurality of points are positioned in an array of rows and columns. In some embodiments, the plurality of points are positioned evenly along the perimeter of the placard 4, 304 and in a corresponding pattern on the main section 1, 201. In some embodiments, the plurality of points are positioned in a scattered, non-geometric pattern. In some embodiments, the plurality of points are created as permanent markings on the both the main section 1, 301 and the placard 4, 304. In some embodiments, the plurality of points are displayed as markings that are erasable or as by means of a light. In some embodiments, the plurality of points of the main section 1, 301 are positioned so that they completely or substantially overlap with the plurality of points of the placard 4, 304 when the placard 4, 304 is placed onto the main section 1, 301. In some embodiments, however, the plurality of points of the main section 1, 301 are positioned so that they do not completely or substantially overlap with the plurality of points of the placard 4, 304 when the placard 4, 304 is placed onto the main section 1, 301.

In some embodiments, as shown in FIG. 4, the plurality of points of the main section 1, 301 and the placard 4, 304, are cut to produce a plurality of holes 230 such that the positions of the plurality of holes 230 are substantially or completely equal to the positions of the plurality of points.

In some embodiments, as shown in FIG. 4, the plurality of points 220 are evenly spaced apart. In some embodiments, the plurality of points 220 can be spaced apart by equal to or less than about: 1 inch, 0.5 inch, 0.25 inch, 0.1 inch, or ranges including and/or spanning the aforementioned values. In other embodiments, the plurality of points 220 are not evenly spaced apart or some but not all of the plurality of points 220 are evenly spaced apart.

Likewise, in some embodiments, as shown in FIG. 4, the plurality of holes 230 are evenly spaced apart. In some embodiments, the plurality of holes 230 can be spaced apart by equal to or less than about: 1 inch, 0.5 inch, 0.25 inch, 0.1 inch, or ranges including and/or spanning the aforementioned values. In other embodiments, the plurality of holes 230 are not evenly spaced apart or some but not all of the plurality of holes 230 are evenly spaced apart.

In some embodiments, the plurality of points 220 are cut, as shown in FIG. 4, using manual (e.g., by-hand and/or without tools) technologies. Such technologies include cutting metal using a saw, chisel, shear or snips. In some embodiments, the plurality of points 220 are cut using machine technologies. Such technologies include turning, milling, drilling, grinding, and sawing. In some embodiments, the plurality of points 220 are cut using welding or burning technologies. Such technologies include using a laser, oxy-fuel burning, and plasma. In some embodiments, the plurality of points 220 are cut using erosion-based technologies. Such technologies include using a water jet, electric discharge, and abrasive flow machining. In some embodiments, the plurality of points 220 are cut using chemical technologies. Such technologies include photochemical machining.

In some embodiments, as shown, coupling features 24 are attached to the plurality of holes 230 of the main section 1, 201 and the placard 4, 204. In some embodiments, the coupling features 224 are permanently attached to the plurality of holes 23. In some embodiments, the coupling features 224 are removably attached to the plurality of holes 230. The method of removing such coupling features 224 can include manual (e.g., by-hand and/or without tools) removal or removal by machine.

In some embodiments, as shown, the placard 4, 204 is attached to the main section 1, 201. In some embodiments, the placard 4, 204 is attached so that it is substantially or completely bounded by the outline 200 of the main section 1, 201. In some embodiments, the placard 4, 204 is attached so that it is not substantially bounded by the outline 200 of the main section 1, 201. In some embodiments, the placard 4, 204 is permanently attached to the main section 1, 201. In some embodiments, however, the placard 4, 204 is removably attached to the main section 1, 201.

Figure 5:
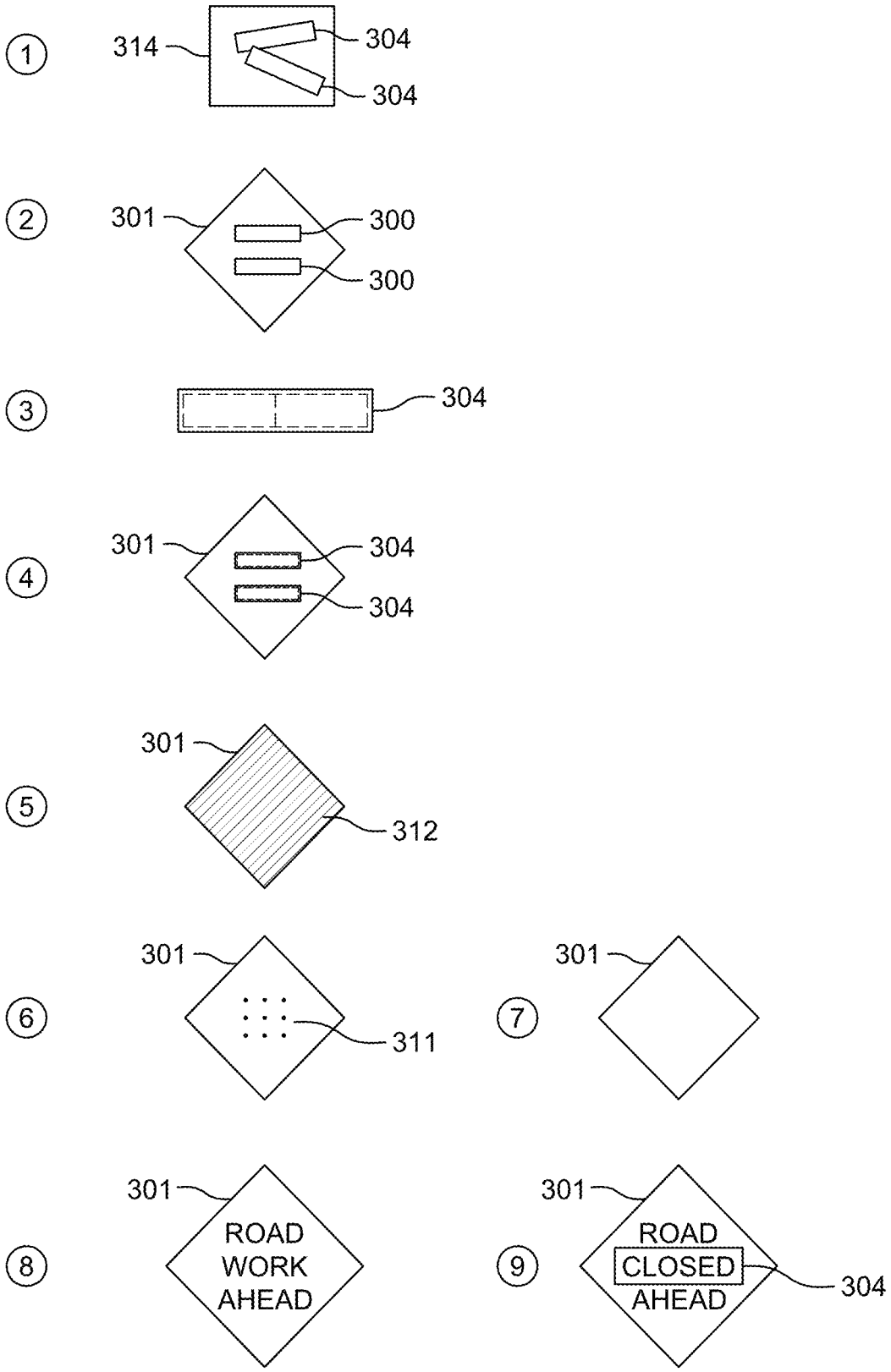
FIG. 5 illustrates a second method of manufacturing an embodiment of a road sign.

FIG. 5 shows an embodiment of another method of manufacturing an adaptable road sign. In some embodiments, as shown in FIG. 5, the method comprises a step of cutting both the main section 301 and the placard 304 from a sign material 314. In some embodiments, this first step comprises cutting the main section 301 and the placard 304 according to specified sign standards. In some embodiments, this first step comprises ensuring that each placard 304 is large enough to cover any written messages and/or pictorial representations that will overlay the main section 301. In some embodiments, the sign material 314 that is used is metal (e.g., Max-metal). In some embodiments, the sign material 314 comprises multiple materials, including Max-metal.

In some embodiments, as shown in FIG. 5, the method comprises a step of drawing an outline 300 on the main section 301 to indicate where the placard 304 is to be placed. In some embodiments, the outline 300 is proportional to, but does not coincide with, the shape of the desired placard 304. In some embodiments, the outline 300 coincides with the placard 304. In some embodiments, the outline 300 is drawn in the shape of a square. In some embodiments, the outline 300 is drawn onto the main section 301 in accordance with Federal Highway Administration standards of measurements for sign production. In some embodiments, the outline 300 is drawn onto the main section 301 in accordance with the relevant US state requirements for construction sign and/or road sign safety.

In some embodiments, as shown in FIG. 5, the method comprises a step of making measurements on the placard 304 for the purpose of making a plurality of holes 220, as shown in FIG. 4. As shown in FIG. 5, in some embodiments the measurements are taken by drawing on the placard 304. In some embodiments, the measurements are taken one inch from the edge of the placard. As shown, the measurements are taken, in some embodiments, in the shape of two rows and three (or four) columns. In some embodiments, the measurements can be spaced apart by equal to or less than about: 1 inch, 0.5 inch, 0.25 inch, 0.1 inch, or ranges including and/or spanning the aforementioned values.

In some embodiments, as shown in FIG. 5, the method comprises a step of creating holes on the placard 304. In some embodiments, holes are also created in the main section 301 itself using the outline 300 as a guide so that the holes in the placard 304 and the holes in the main section 301 substantially or completely coincide when the placard is placed on the main section 301. In some embodiments, the holes can be spaced apart by equal to or less than about: 1 inch, 0.5 inch, 0.25 inch, 0.1 inch, or ranges including and/or spanning the aforementioned values. In some embodiments, each hole can have a width equal to or less than about: 1 inch, 0.5 inch, 0.25 inch, 0.1 inch or ranges including and/or spanning the aforementioned values. In some embodiments, the holes have a width of 0.625 inches.

In some embodiments, as shown in FIG. 5, the method comprises a step of covering the entire main section 304 with a masking material 12, 312. In some embodiments, the masking material 12, 312 substantially or completely covers both sides of the main section 304. In some embodiments, the masking material 12, 312 substantially or completely covers only the side of the main section 304 that will display a visual indicator intended for passersby. In some embodiments, the masking material 12, 312 comprises a retroreflective layer.

In some embodiments, the method comprises a step of direct digital printing a visual indicator (e.g., using solvent-based or latex-based ink) on the main section, the placard, or both. In some embodiments, the visual indicator is direct digital printed on the main section after the main section 1, 201 is cut from the material 14, 214. In some embodiments, the visual indicator is direct digital printed on the main section before the main section 1, 201 is cut from the material 14, 214. In some embodiments, the visual indicator is direct digital printed on the placard after the placard 4, 204 is cut from the sign material 14, 214. In other embodiments, the visual indicator is direct digital printed on the placard before the placard 4, 204 is cut from the sign material 14, 214.

In some embodiments, the method comprises a step of preparing a visual indicator—to be placed on the main section, the placard, or both—via vinyl lettering. In some embodiments, vinyl lettering can be used to create letters, numbers, shapes, and other designs. In some embodiments, one advantage of using vinyl lettering is that it allows the desired visual indicator to be easily installed as one piece on the main section or placard.

In some embodiments, as disclosed elsewhere herein, some of the one or more magnets 11, 311 are arranged as points on a polygon. For example, in some embodiments, four magnets are arranged together as points on a trapezoid. In some embodiments, some magnets 11, 311 are arranged as points on a line. FIG. 7 illustrates an embodiment in which some magnets are arranged as points on a line and other magnets are arranged as points on a triangle. In some embodiments, some magnets are arranged as points on a polygon and these magnets do not all share the same polarity. In some embodiments, some magnets are arranged as points on a line and all of these magnets share the same polarity.

In some embodiments, the array of magnets can include various groups of three magnets arranged as points on a triangle, wherein three lines drawn to the three magnets to form a triangle result in the three angles of that triangle, each angle being equal to or less than about: 2 degrees, 5 degrees, 10 degrees, 15 degrees, 20 degrees, 30 degrees, 40 degrees, 50 degrees, 60 degrees, 70 degrees, 80 degrees, 90 degrees, 100 degrees, 105 degrees, 110 degrees, 115 degrees, or ranges including and/or spanning the aforementioned values. In other embodiments, each angle is equal to or less than about: 40 degrees, 50 degrees, 70 degrees, 90 degrees, 110 degrees, 130 degrees, 150 degrees, 170 degrees, 175 degrees, 179 degrees, or ranges including and/or spanning the aforementioned values.

In some embodiments, the one or more magnets 11, 311 are arranged such that the distance between any two adjacent magnets is equal to or less than about: 5 mm, 10 mm, 15 mm, 30 mm, 45 mm, 60 mm, 75 mm, 90 mm, 105 mm, 120 mm, or ranges including and/or spanning the aforementioned values. In some embodiments, the ratio of distance between two magnets and a linear dimension (e.g., length or width) of the magnets is less than or equal to about: 15:1, 10:1, 5:1, 4:1, 3:1, 2:1, 1:1, or ranges including and/or spanning the aforementioned ratios.

In some embodiments, as shown in FIG. 5, the method comprises a step of inserting one or more magnets 11, 311 (or other coupling features) into the holes in the main section 301. In some embodiments, the one or more magnets 11, 311 (or other coupling features) are inserted from the back side of the main section 301. In some embodiments, in which the holes are arranged in, or substantially arranged in, rows and columns, the one or more magnets 11, 311 (or other coupling features) are inserted so that the one or more magnets 11, 311 (or other coupling features) on the top row have the same polarity and the one or more magnets 11, 311 (or other coupling features) on the bottom row have the opposite polarity. In some embodiments, some of the one or more magnets 11, 311 are arranged so that their polarities are alternating. In some embodiments, the one or more magnets 11, 311 (or other coupling features) are inserted into the main section 301 from the front side (i.e., the side that will display a message for passersby).

In some embodiments, as shown in FIG. 5, the method comprises a step of covering the main section 301 to keep the one or more magnets 11, 311 (or other coupling features) in place. In some embodiments, the one or more magnets 11, 311 (or other coupling features) are attached to, or resting in holes made in, the back side of the main section 301, and only the back side of the main section 301 is covered. In some embodiments, both sides of the main section 301 are covered. In some embodiments, as shown, both sides of the main section 301 are covered, but the two sides can be covered by different means and/or with different material.

In some embodiments, as shown in FIG. 5, the method comprises a step of decorating the main section 301 with, or otherwise drawing or displaying thereon, a visual indicator. For example, in some embodiments, the main section 301 can be decorated with the visual indicator 7, as shown in FIG. 1A. Like the visual indicator 7 in FIG. 1A, in some embodiments, the visual indicator that is displayed on the main section 301 may read "Road Word Ahead." In some embodiments, the visual indicator is selected from any one or more of the written messages or pictorial representations illustrated in FIG. 3.

In some embodiments, as shown in FIG. 5, the method comprises a step of placing or otherwise displaying on the main section 301 any one or more of the following: a legend, a symbol, and a border of the road sign. In some embodiments, each of the legend, symbol (or symbols), and border(s) of the sign are placed or otherwise displayed on the main section 301. In some embodiments, any written message and/or pictorial representation, including any legend, symbol(s), and border(s) of the sign are made in accordance with the standards set forth in the Manual on Uniform Traffic Control Devices ("MUTCD").

In some embodiments, as shown in FIG. 5, a ninth step comprises attaching the placard 304 to the main section 301. In some embodiments, the placard 304 is attached to the main section 301 only with the aid of non-mechanical and/or non-electrical hand tools. In other embodiments, the placard 304 is attached only with the aid of mechanical and/or electrical hand tools. In some embodiments, the placard 304 and/or the main section 301 are configured so that the placard 304 can be attached to the main section 301 with either non-mechanical/non-electrical or mechanical/electrical tools.

Some embodiments pertain to a method of using an adaptable sign as disclosed herein. In some embodiments, the method comprises acquiring an adaptable sign. In some embodiments, the adaptable sign is positioned at a target location. In some embodiments, the target location is a construction site, a site along the side of and/or in a road and/or sidewalk, and/or a site in proximity to a hazard (e.g., a road hazard or pedestrian hazard). In some embodiments, the method includes a step of attaching a first placard to the sign. In some embodiments, the first placard comprises a first message. In some embodiments, the method includes a step of removing the first placard with a first message from the sign. In some embodiments, the first placard is replaced with a second placard with a different message.

In some embodiments, the adaptable road signs disclosed herein are not electric and/or do not comprise electronic and/or electrical components. In some embodiments, the adaptable road signs do not comprise messages that are displayed using electronic components (e.g., light bulbs or light emitting diodes).

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

In summary, various embodiments and examples of road signs have been disclosed. Although the road signs have been disclosed in the context of those embodiments and examples, it will be understood by those skilled in the art that this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

EXAMPLE

Example 1

An adaptable road sign was manufactured as follows. A placard and the main section of a road sign were cut from a sheet of Max-metal according to specific signs standards that are in compliance with the Federal Highway Administration's National Standards for Traffic Control Devices and applicable state requirements. A square was drawn on the main section, indicating where the placard should be placed when the sign is in use.

One-inch measurements were taken along the perimeter and down the middle of the placard and the placard was marked to indicate where holes should be drilled. Holes measuring 0.625 inches in diameter were drilled into the placard and the sign face. A retroflective layer was placed on the front side of the main section so that the holes were completely covered.

From the rear side of the main section, magnets were inserted into the holes in an array, the array consisting of a top row of magnets sharing one polarity and a bottom row of magnets all sharing the opposite polarity. From the rear side of the main section, each of the holes was then covered with self-adhesive white reflective sheeting measuring two square inches to keep the magnets in place. A second layer of white vinyl was placed on top of the white reflective sheeting to block the reflectivity.

From the rear side of the placard, magnets were inserted into the holes in an array, the array consisting of a top row of magnets having the opposite polarity of the magnets of the top row in the main section and a bottom row of magnets having the opposite polarity of the magnets of the bottom row in the main section. From the rear side of the placard, each of the holes was then covered with self-adhesive white reflective sheeting measuring two square inches to keep the magnets in place. A second layer of white vinyl was placed on top of the white reflective sheeting to block the reflectivity.

The legend, symbols, and borders of the sign were printed on reflective sheeting. The reflective sheeting backing was removed and the reflective sheeting was applied to the main section in accordance with the Federal Highway Administration's Manual on Uniform Traffic Control Devices. A similar process was repeated to apply reflective sheeting with a design to the placard.

What is claimed is:

1. A road sign, comprising:

a main section comprising a face having a coupling area comprising a first plurality of magnetic features, the coupling area configured to adhere a first placard having a first size to the face of the main section via magnetic force when the face is in a substantially vertical position;

wherein the face of the main section is substantially flat and comprises a default message regarding a road condition;

wherein the plurality of magnetic features comprises at least a first magnetic element and at least a second magnetic element;

wherein, at a position at the face of the sign, the first magnetic element and the second magnetic element have different polarities;

wherein the sign is configured to receive the first placard at a first specific area of the sign face that comprises the first magnetic element and the second magnetic element thereby covering at least a portion of the default message and changing the default message of the sign; and wherein the sign is also configured to receive a second placard having a second size at a second specific area of the sign face, the second specific area of the sign face being different from the first specific area and the first size being different than the second size.

2. The sign of claim 1, wherein the sign further comprises the first placard and the second placard.

3. The sign of claim 1, wherein the first specific area of the sign face comprises magnetic features that are arranged in a first array and wherein the first placard comprises a plurality of magnetic features arranged in an array coinciding to the first array of magnetic features.

4. The sign of claim 3, wherein the magnetic features of the first placard are of opposite polarity to the first array so that the magnetic features of the sign are attracted to the array of magnetic features of the first placard.

5. The sign of claim 1, wherein the magnetic features of the sign are embedded within the main section of the sign and are substantially flush with the sign face.

6. The sign of claim 5, wherein the magnetic features of the placard are embedded within the placard and are substantially flush with a surface of the placard.

7. The sign of claim 1, wherein the placard has a different message on its front and back surfaces.

8. The sign of claim 1, wherein the sign face lacks any tracks or ledges that are configured to suspend the placard.

9. The sign claim 1, wherein the sign face lacks any adhesive element other than the plurality of magnetic features.

10. A message conveying system comprising the sign of claim 1 and the placard.

11. A kit comprising the sign and placard of claim 1.

12. The kit of claim 11 comprising a stand for the sign.

13. A method of manufacturing a road sign, comprising:

preparing a main section of the sign, the main section comprising a face having a coupling area, the coupling area configured to receive and adhere to a first placard;

wherein the face of the main section is substantially flat when the placard adheres to the coupling area;

wherein the coupling area is configured to magnetically adhere the placard to the face when the face is in a substantially vertical position;

wherein the sign is configured to receive the first placard at a first specific area of the sign face thereby changing at least a portion of the default message;

wherein the sign is configured to receive a second placard having a second size at a second specific area of the sign face that is different from the first; and wherein the first area of the sign face is configured to not receive a second placard that is different from the first placard.

14. The method of claim 13, further comprising introducing at least one coupling feature into the coupling area.

15. The method of claim 13, wherein the coupling feature comprises a magnet.

16. A road sign, comprising:

a main section comprising a face having a coupling area comprising a plurality of magnetic features, the plurality of magnetic features comprising at least a first magnetic element having a first polarity at the face of the sign and at least a second magnetic element having a second polarity at the face of the sign, the first and the second polarities being different;

wherein the coupling area comprises a first array of magnets at a first specific area of the sign face, the first array of magnets being configured to couple with a first placard at the first specific area;

wherein the sign face is configured to not receive the first placard on areas of the sign face other than the first specific area; and wherein the sign face is configured to couple with the first placard only when the first placard is in an upright position.

17. The road sign of claim 16, wherein the coupling area comprises a second array of magnets at a second specific area, the second array of magnets being configured to couple with a second placard at the second specific area.

18. The road sign of claim 17, wherein the first array of magnets at a first specific area is configured to repel the second placard.

19. The road sign of claim 16, wherein the sign further comprises the first placard.

* * * * *